US007864150B2

(12) United States Patent
Shih

(10) Patent No.: US 7,864,150 B2
(45) Date of Patent: Jan. 4, 2011

(54) DRIVING METHOD FOR A LIQUID CRYSTAL DISPLAY

(75) Inventor: Po-Sheng Shih, Taoyuan (TW)

(73) Assignee: Hannstar Display Corporation, Taoyuan (TW)

( * ) Notice: Subject to any disclaimer, the term of this patent is extended or adjusted under 35 U.S.C. 154(b) by 737 days.

(21) Appl. No.: 10/905,111

(22) Filed: Dec. 16, 2004

(65) Prior Publication Data

US 2005/0219187 A1 Oct. 6, 2005

(30) Foreign Application Priority Data

Apr. 1, 2004 (TW) ..... 93109015 A

(51) Int. Cl.
*G09G 3/36* (2006.01)
*G09G 3/18* (2006.01)

(52) U.S. Cl. ..... 345/94; 345/53

(58) Field of Classification Search ..... 345/76, 345/53, 94, 211, 87
See application file for complete search history.

(56) References Cited

U.S. PATENT DOCUMENTS 5,151,805 A * 9/1992 Takeda et al. ..... 345/94
5,648,793 A * 7/1997 Chen ..... 345/96
5,784,039 A * 7/1998 Yasui et al. ..... 345/89
7,154,463 B2 * 12/2006 Kwag ..... 345/94
2003/0048246 A1 * 3/2003 Ham ..... 345/87

OTHER PUBLICATIONS

Nose et al., "A Black Stripe Driving Scheme for Displaying Motion Pictures on LCDs", SID'01 Digest, pp. 994-997.
Nakamura et al., "A Novel Wide-Viewing—Angle Motion—Picture LCD", SID'98 Digest.
Hector et al., "Low Power Driving Options for an AMLCD Mobile Display Chipset", SID'02 Digest, pp. 694-697.
Nakao et al., "Response Time Improvement of OCB Mode TFT-LCDs by Using Capacity Coupled Driving Method", IDW'00, pp. 215-218.

* cited by examiner

*Primary Examiner*—Kevin M Nguyen
(74) *Attorney, Agent, or Firm*—Jianq Chyun IP Office

(57) ABSTRACT

A driving method for a liquid crystal display is provided. A pre-charge voltage value is applied to a scan line, where the voltage level does not manage to turn on the thin film transistor of the associated pixel, before a scan signal is applied to the scan line of the liquid crystal display. The pre-charge voltage level is electrically connected to the pixel voltage of the scan line via a storage capacitor to the neighboring pixel.

13 Claims, 22 Drawing Sheets

DRIVING METHOD FOR A LIQUID CRYSTAL DISPLAY

CROSS-REFERENCE TO RELATED APPLICATION

This application claims the priority benefit of Taiwan application serial no. 93109015, filed Apr. 1, 2004.

BACKGROUND OF THE INVENTION

1. Field of Invention

The present invention relates to a driving method for a liquid crystal display, and more particularly, to a pre-charge method for a liquid crystal display, wherein a pre-charge voltage value is applied to a scan line before a scan signal is electrically coupled to the neighboring pixel via a storage capacitor.

2. Description of the Related Art

A liquid crystal display advances, not only in dimension thereof, but also in larger variety of image types. For example, most LCDs are used for still images on a personal computer or a word-processing product, yet currently most products are capable of displaying motion pictures, such as LCD television. Since a LCD is rather smaller and thinner than conventional cathode ray tube television, and is not space consuming after installed, it is foreseeable that LCD is getting more and more popular for human life.

Referring to FIG. 1, a conventional LCD structure is illustrated. The LCD includes a first layer glass substrate and a second layer glass substrate, wherein the CLD panel 100 is for displaying an image. A plurality of scan lines 101 (n lines as shown in the figure) and signal lines (m lines as shown in the figure) are disposed over the first layer glass substrate in grid-like arrangement. The thin film transistors 103 serving as switches are disposed in vicinity of cross points of each scan line 101 and signal line 102.

A gate of each TFT 103 is coupled to one of the scan lines 101, a source of which is coupled to one of the signal lines 10, and a drain of which is coupled to one pixel electrode 104. Said second layer of glass substrate is disposed against the first layer of glass substrate, formed with a common electrode 105 comprised of such as ITO (indium tin oxide). The liquid crystal is stuffed between the first layer of glass substrate and a second layer of glass substrate.

Scan lines 101 and signal lines 102 are respectively coupled to a scan line driving circuit 106 and a signal line driving circuit 107. The scan line driving circuit 106 drives a large voltage level to the n scan lines 101 and switches on each of the TFTs 103 associated with the scan lines 101. Since the scan line driving circuit 106 is at a scanning state, the signal driving circuit 107 outputs representative image having gradation voltage for m signal lines, so that the voltage is coupled to the TFT 103 via the scan line 102 to write the corresponding pixel electrode 104. The written pixel electrode 104 has a gradation voltage differed with a voltage level of the common electrode 105 for controlling brightness of transmitted light.

Referring to FIG. 2, a waveform diagram of the conventional LCD from the scan line driving circuit 106 to the scan line 101, and from the signal line driving circuit 107 to the signal line 102 is illustrated. Where $V_{G1}$ to $V_{Gn}$ are scanning signals of each of the scan lines 101. It is clearly seen that each of the intervals of $V_{G1}$ to $V_{Gn}$ provides only one scan line 101, and sequentially to all of the scan lines 101. Where VD is a data signal of a gradation voltage outputted to the signal line 102. The strength of the data signal (amplitude of the voltage level thereof) is determined by the image to be displayed. $V_{com}$ is a voltage level of the common electrode 105, usually keeping invariant with time.

If serving the aforementioned conventional LCD as motion image display, e.g. current television system, a large amount of motion images is required. However, according to hold-type addressing method of the LCD the displaying light is retained for a field period long, from data written to the pixel to writing operation for the next period. Therefore edge blur is incurred. In order to solve the problem, a lot of improvements were proposed, such as "A Black Stripe Driving Scheme for Displaying Motion Pictures on LCDs" by T. Nose, M. Suzuki, D. Sasaki, M. Imai, and H. Hayama disclosed by NEC in Society for Information Display in 2001. The structure of which circuitry is complicated, and requires special gate input waveform and higher data frequency. On the other hand, RC delay effect is induced from gate circuitry, so that not applicable to panels with large dimension and higher resolution.

Furthermore, "A Novel wide-Viewing-Angle Motion-Picture LCD" by G. Nakamura, K. Miwa, M. Noguchi, Y. Watbale, and J. Mamiya is disclosed by IBM Japan in SID in 1998. The structure thereof is divided into upper half portion and lower half portion, so that two data driving IC are required. Not only higher cost is required, transmittance of liquid crystal cell is drastically lowered since black-insert-ratio is merely fixed at 50%.

According to the conventional schemes mentioned above and technology that is known to the skill in the art, a lot of problems do exist, i.e. panels are not suitable for large dimension or high resolution, or only capable of row inversion driving method.

In order to implement a panel with large dimension and high resolution, manufactures in the relevant industry proposes another LCD structure 300, where an equivalent circuit diagram is illustrated in FIG. 3. For simpler description, only a portion of the structure is illustrated therein. The LCD structure 300 includes a scan line 301(n) and 301(n+1), and a signal line 302(n) and signal line 302(n+1). TFT 303(n) and 303(n+1) thus correspond to the signal line 301(n) and signal line 302(n).

The TFT, e.g. 303(n), of the LCD structure 300 having wide viewing angle, is coupled to the scan line 301(n) via a agate, and a source thereof is coupled to the signal line 302(n). A drain of the TFT 303(n) is coupled to the gate thereof via a gate/drain capacitor $C_{gd}$, coupled to the scan line 301(n+1) via a storage capacitor $C_{st}$, and coupled to the common electrode is a liquid crystal capacitor $C_{lc}$.

Similarly for the neighboring TFT 303(n+1), a gate is coupled to the scan line 301(n+1), a source is coupled to the signal line 302(n+1). A drain of which is coupled to the gate thereof via a $C_{gd}$, coupled to the previous scan line 301(n) via a $C_{st}$, and coupled to the $V_{com}$ via a $C_{lc}$.

The driving method of the LCD structure 300 follows the waveform diagram illustrated in FIG. 4, which is a capacitively couple driving method. According to the figure, voltage levels $V_{g(n)}$ and $V_{g(n+1)}$ respectively supply the scan lines 301(n) and 301(n+1), and voltage levels $V_{s(n)}$ and $V_{s(n+1)}$ respectively supply the signal lines 302(n) and 302(n+1). The driving method includes four gate voltage values, i.e. TFT on voltage, TFT off voltage, $V_{g(+)}$ and $V_{g(-)}$. First, the signal voltage $V_s$ is coupled to the pixel electrode via the TFT. After charging the pixel, the capacitively coupled driving voltage including a previous or a next stage of scan line is transmitted to the pixel electrode $V_{g(+)}$ and $V_{g(-)}$ fed back from the $C_{st}$.

The driving method is advantageous that pixel voltage can be larger than that supplying to the signal, i.e. the signal value can be tiny. In such a LCD driving structure, since neighboring scan lines are constantly provided voltage value with opposite polarity (i.e. column inversion driving structure), therefore, voltage level fluctuation due to capacitance between signal lines and the common electrode through this driving method. This driving structure can also eliminate vertical cross-talk caused by parasitic capacitance between signal lines and the pixel electrode.

Another conventional LCD structure is disclosed in "Response Time Improvement of OCB mode TFT-LCDs by using Capacitively Coupled Driving Method" by Kenji Nakao, Shoichi Ishihara, Yoshinori Tanaka, Daiichi Suzuki, Tsuyoshi Uemura, Keisuke Tsuda, Noriyuki Kizu and Junichi Kobayashi by Matsushita Electric. Co. in SID 2000, wherein an optically self-compensated birefringence, OCB, with rapid response is proposed for the LCD. Capacitively Coupled voltage is used in this driving method, where a voltage level is coupled to the neighboring pixel electrode via storage capacitor between neighboring scan line and pixel electrode, so as to overdrive the pixel to obtain rapid response.

In addition, another conventional LCD structure is applicable to lower power consumption. For example "Low Power Driving Options for an AMLCD Mobile Display Chipset" by Jason Hector and Pascal Buchschacher is disclosed in SID 2002, where lower power consumption of LCD is achieved with the proposed structure thereof. In order to narrow the operating voltage range, the driving method uses capacitively coupling method to pre-charge a pixel electrode via $C_{st}$ between neighboring scan line and pixel electrode. For example, during positive field, a positive voltage of $(V_{sat}+V_{th})/2$ is applied, where $V_{sat}$ is saturation voltage of the pixel electrode, and $V_{th}$ is threshold voltage thereof. Hence voltage range is narrowed so as to lower power consumption.

The foregoing LCD and driving method are advantageous, yet merely applicable to column inversion driving method or row inversion driving method. However, larger and larger dimension of LCD is required, where the driving method is thus developed as dot inversion driving method as opposed to conventional driving method that are outdated.

SUMMARY OF THE INVENTION

The present invention provides a driving method for a liquid crystal display, where a voltage value is pre-charged to a scan line before a pixel having a TFT of the LCD is switched on, and pre-charged voltage value does not switch on the TFT itself. The pre-charged voltage value is capacitively coupled to the neighboring pixel that is coupled to the scan line via storage capacitor.

Given the driving method according to an embodiment in the present invention, the voltage value of the pixel electrode is kept at a voltage value of the common electrode, or close to that. Therefore, edge blur of an image is avoided since black frame insertion and hold-type addressing method both applies to the LCD.

Given the driving method according to an embodiment of the present invention, an overdrive and reduced power consumption method is provided. The pixel electrode is pre-charged with a voltage value for overdrive the pixel so that power consumption is reduced according to this embodiment.

The method of this present invention, dot inversion driving applies for black frame insertion, liquid crystal overdrive, and reduced power consumption, so as to implement large dimensional LCD.

In one aspect of the present invention, a LCD driving method is provided for a LCD structure. The LCD structure includes a plurality of scan lines and a plurality of signal lines, where each of the scan lines and each of the signal lines is coupled to a corresponding pixel via a TFT. A gate of the TFT is coupled to the corresponding scan line, a source of the TFT is coupled to the corresponding signal line, and a drain of the TFT is coupled to a scan line neighboring to the scan line via a storage capacitance, and also coupled to a common electrode via a pixel electrode of the pixel. A voltage value of the common electrode is a common voltage value. The driving method of the LCD includes biasing the scan line to a scan voltage for opening the TFT corresponding to the scan line, and biasing the signal line coupled to the drain of the TFT with a signal voltage level, pre-charging the neighboring scan line with a pre-charge voltage, and coupling the voltage level of the pixel electrode via the storage capacitance.

In one aspect of the present invention, the voltage value of the pixel electrode changes by $C_{st}/C_{total}\cdot(V_{pre})$, where $V_{pre}$ is a pre-charge voltage value, $C_{st}$ is storage capacitance of the pixel, and $C_{total}$ is total capacitance of the pixel electrode.

In one aspect of the present invention, the LCD driving method includes biasing the scan line with a scan line voltage to switch on the TFT of the pixel, the scan line is kept at a first voltage level within a first time interval, pre-charging the scan line with a pre-charge voltage to a second voltage level within a second time interval. Where the second voltage level does not manage to switch on the TFT, and the pixel electrode of a neighboring pixel coupled to the scan line is capacitively coupled to the pre-charge voltage in feedback fashion.

In one aspect of the present invention, the LCD driving method includes biasing a positive pre-charge voltage to the pixel electrode to approach the common voltage value of the common electrode when the voltage value of the pixel electrode is smaller than that of the common electrode, and retaining the voltage value within the second time interval. In this aspect of the present invention, black frame insertion of the LCD is completed within the second time interval.

In another aspect of the present invention, the LCD driving method includes biasing the scan line with a scan voltage to a second voltage level within a third time interval, biasing the scan line to a first voltage level within a fourth time interval, where the pixel electrode of a neighboring pixel coupled to the scan line is capacitively coupled to the pre-charge voltage in feedback fashion.

According to the LCD driving method as described above, the pixel electrode is biased with a negative pre-charge voltage to approach the common voltage value of the common electrode when the voltage level of the pixel electrode is larger than that of the common electrode, and retaining the voltage value within the fourth time interval. In this aspect of the present invention, black frame insertion of the LCD is completed within the second time interval.

According to the aforementioned aspects of the present invention, a LCD driving method is provided, including biasing the neighboring scan line with pre-charge voltage and coupling to the pixel electrode via the storage capacitance, and keeping the pixel electrode at a voltage value similar to that of the common electrode within a feedback time interval. The method of biasing the neighboring scan line includes when the scan line is biased with a scan voltage level so that TFTs of the pixel are switched on, the scan line is biased to a first voltage level, biasing the scan line with a pre-charge voltage from the first voltage level to a second voltage level within a first feedback time interval, wherein the second voltage level does not manage to switch on the TFTs of the pixel. The voltage level of the pixel electrode is similar to that of the common electrode within the first feed back interval.

According to the LCD driving method in one aspect of the present invention, the pixel value of the neighboring pixel which is capacitively coupled to the scan line is changed to $(C_{st}/C_{total})\cdot V_{pre}$, where $V_{pre}$ is a pre-charge voltage, $C_{st}$ is storage capacitance of the pixel, and $C_{total}$ is the total capacitance of the pixel.

According to one aspect of the present invention, the LCD driving method includes biasing a positive pre-charge voltage to the pixel electrode to approach the common voltage value of the common electrode when the voltage value of the pixel electrode is smaller than that of the common electrode, and retaining the voltage value within the first feedback time interval. In this aspect of the present invention, black frame insertion of the LCD is completed within the first feedback time interval.

According one aspect of the present invention, the LCD driving method is provided, wherein the method of biasing the neighboring scan line includes when the scan line is biased with a scan voltage level so that TFTs of the pixel are switched on, the scan line is biased to a first voltage level, biasing the scan line with a pre-charge voltage from the first voltage level to a third voltage level within a second feedback time interval, wherein the third voltage level does not manage to switch on the TFTs of the pixel.

According to the LCD driving method in one aspect of the present invention, the pixel value of the neighboring pixel which is capacitively coupled to the scan line is changed to $(C_{st}/C_{total})\cdot V_{pre}$, where $V_{pre}$ is a pre-charge voltage, $C_{st}$ is storage capacitance of the pixel, and $C_{total}$ is the total capacitance of the pixel.

According to one aspect of the present invention, the LCD driving method includes biasing a positive pre-charge voltage to the pixel electrode to approach the common voltage value of the common electrode when the voltage value of the pixel electrode is smaller than that of the common electrode, and retaining the voltage value within the second feedback time interval. In this aspect of the present invention, black frame insertion of the LCD is completed within the second feedback time interval.

According to one aspect of the present invention, a LCD driving method is provided, wherein the pixel electrode is biased with a pre-charge voltage with capacitively coupled feedback method via storage capacitance to the neighboring scan line, so that difference between the voltage level of the pixel electrode and that of the common electrode is increase. When the voltage level of the pixel electrode is larger then that of the common electrode, the pixel electrode is biased with a positive pre-charge voltage when the voltage level thereof is smaller than that of the common electrode, and biased with a negative pre-charge voltage when the voltage level there of is larger than that of the common electrode, so that difference between the voltage level of the pixel electrode and that of the common electrode is increased.

According one aspect of the present invention, the LCD driving method is provided, wherein the method of biasing the neighboring scan line includes when the scan line is biased with a scan voltage level so that TFTs of the pixel are switched on, the scan line is biased to a first voltage level within a first time interval, biasing the scan line with a pre-charge voltage from the first voltage level to a second voltage level within a second time interval. Where the first time interval is shorter than the second time interval, the second voltage level does not manage to switch on the TFTs of the pixel and the pre-charge voltage is coupled to the pixel electrode of the neighboring pixel that is coupled to the scan line in capacitively coupled feedback fashion.

According to the LCD driving method as described above, wherein the voltage level of the pixel electrode is changed and retained within a second time interval, where the second time interval is hundreds to thousands times longer than the first time interval. For example, if the second time interval is in millisecond (ms) order, the first time interval is in microsecond (μs) order.

According to one aspect of the present invention, a LCD driving method is provided, wherein the method of biasing the scan line includes biasing the scan line to a second voltage level within a third time interval, biasing the scan line to a first voltage level within a fourth time interval, wherein the third time interval is shorter than the fourth time interval, the pre-charge voltage is coupled to the pixel electrode of the neighboring pixel that is coupled to the scan line in capacitively coupled feedback fashion.

According to the LCD driving method as described above, wherein the voltage level of the pixel electrode is changed and retained within a fourth time interval, where the fourth time interval is hundreds to thousands times longer than the third time interval. For example, if the duration of the fourth time interval is in millisecond (ms) order, the duration of third time interval is in microsecond (μs) order.

According to one aspect of the present invention, a driving method is provided, wherein the method of biasing a scan line includes when the scan line is biased with a scan voltage level so that TFTs of the pixel are switched on, biasing the scan line to a first voltage level within a first time interval, biasing the scan line with a pre-charge voltage from the first voltage level to a second voltage level within a second time interval, biasing the scan line with a pre-charge voltage to a third voltage level within a third time interval. Where a sum of the first time interval and the third time interval is shorter than the second time interval, the third voltage level does not manage to switch on the TFTs of the pixel, and the pre-charge voltage is coupled to the pixel electrode of the neighboring pixel that is coupled to the scan line in capacitively coupled feedback fashion, so that difference between the voltage level of the pixel electrode and that of the common electrode is increased.

According to the LCD driving method mentioned above, when the voltage level of the pixel electrode is larger then that of the common electrode, i.e. when the scan line is biased from the first voltage level to the second voltage level, the pixel electrode is biased with a positive pre-charge voltage, such that difference between the voltage level of the pixel electrode and that of the common electrode is increased. When the scan line is biased from the second voltage level to the third voltage level, it is biased with another positive pre-charge voltage, such that difference between the voltage level of the pixel electrode and that of the common electrode is increased further.

According tot he LCD driving method mentioned above, the voltage level of the pixel electrode is changed and kept thereat within the second time interval. The second time interval is hundreds to thousands times longer than the first time interval. For example, if the second time interval is in millisecond (ms) order, the sum of the first time interval and the third time interval is in microsecond (μs) order.

According to one aspect of the present invention, a LCD driving method is provided, where the method of biasing the scan line includes biasing the scan line with a scan voltage to a first voltage level within a first time interval such that all the TFTs of the pixel are switched on, biasing the scan line with a predetermined voltage level to a second voltage level within a second time interval, biasing the scan line with a pre-charge voltage from the first voltage level to a third voltage level within a third time interval. Where a sum of the third time interval and the first time interval is shorter than the second time interval, the first voltage level does not manage to switch on the TFTs of the pixel, and the pre-charge voltage is coupled to the pixel electrode of the neighboring pixel that is coupled to the scan line in capacitively coupled feedback fashion, so that difference between the voltage level of the pixel electrode and that of the common electrode is increased.

According to the LCD driving method mentioned above, when the voltage level of the pixel electrode is larger then that of the common electrode, i.e. when the scan line is biased from the first voltage level to the second voltage level, the pixel electrode is biased with a positive pre-charge voltage, such that difference between the voltage level of the pixel electrode and that of the common electrode is increased. When the scan line is biased from the second voltage level to the third voltage level, it is biased with a negative pre-charge voltage, such that difference between the voltage level of the pixel electrode and that of the common electrode is increased further.

According tot he LCD driving method mentioned above, the voltage level of the pixel electrode is changed and kept thereat within the second time interval and the third time interval. The second time interval is hundreds to thousands times longer than the sum of the first time interval and the third time interval. For example, if the second time interval is in millisecond (ms) order, the sum of the first time interval and the third time interval is in microsecond (μs) order.

DESCRIPTION OF THE EMBODIMENTS

A LCD driving method is provided in this present invention, including biasing a scan line of the LCD with a pre-charge voltage before scan signal is applied, i.e. before TFTs of the LCD pixel is switched on, where the pre-charge voltage does not manage to switch on the TFTs. The pre-charge voltage is capacitively coupled to the neighboring pixel that is coupled to the scan line via storage capacitance thereof.

In the driving method according to one embodiment of the present invention, a voltage level of the pixel electrode is biased to a voltage level of the common electrode, or similar to that of the common electrode. Black frame insertion can thus be implemented, i.e. edge blur of image is avoided for a hold-type addressing method is applied to the LCD.

According to one embodiment of the present invention, liquid crystals are overdriven and power consumption is reduced. In the embodiment of the present invention, a predetermined voltage level is applied to the pixel electrode for overdriving the pixel, and power consumption is thus reduced.

According to the driving method of this present invention, dot inversion driving applies for black frame insertion, liquid crystal overdrive, and reduced power consumption, such that large dimensional LCD can be fabricated. The following is descriptions of the embodiments of the present invention.

The First Embodiment

Figure 1:
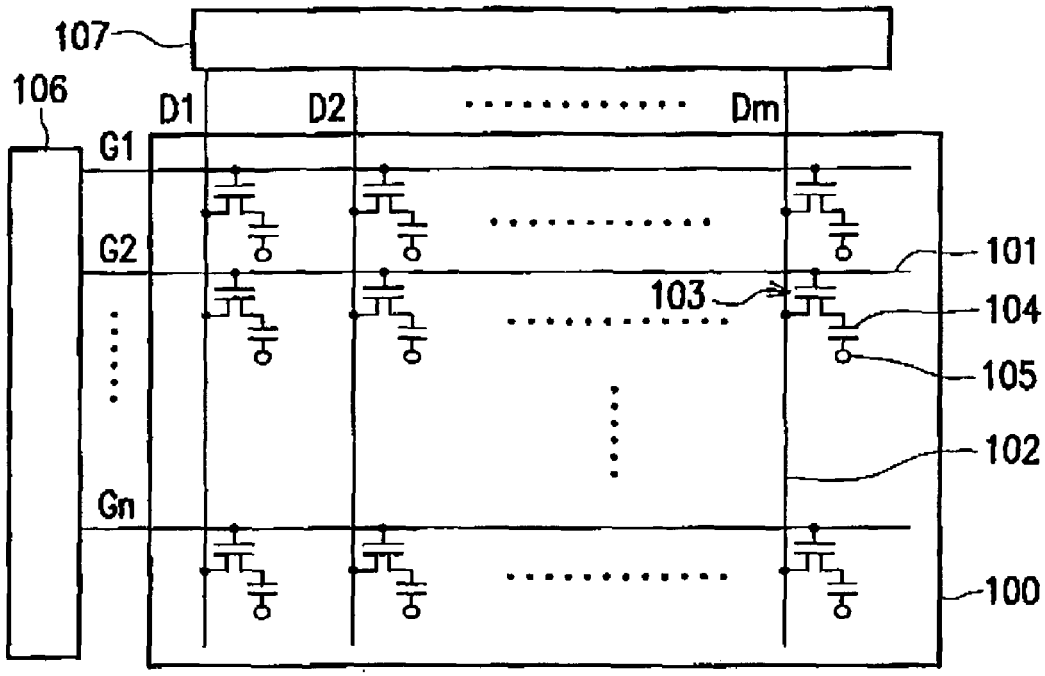
FIG. 1 (PRIOR ART)
FIG. 1 is a schematic structure diagram of a liquid crystal display according to conventional art.
Figure 2:
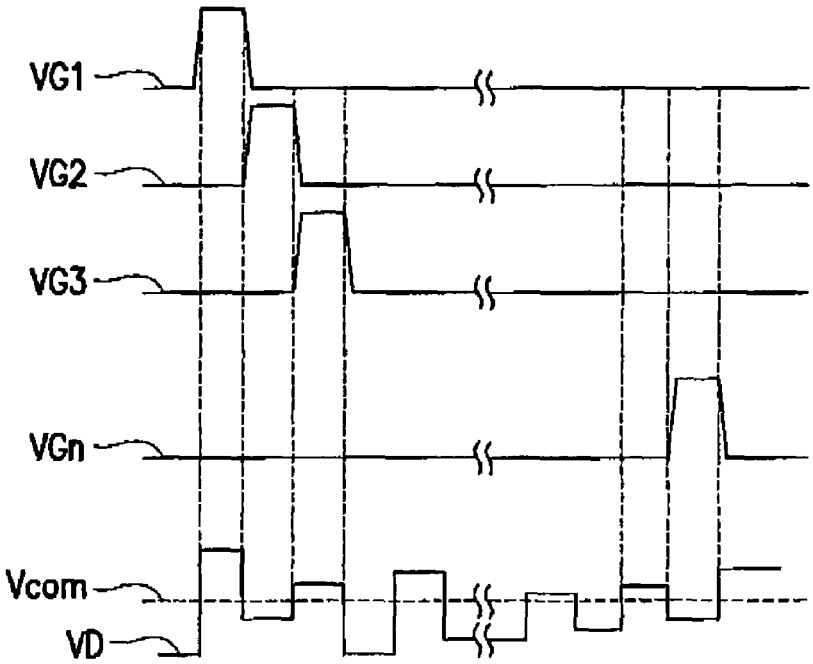
FIG. 2 (PRIOR ART)
FIG. 2 is a waveform diagram of a liquid crystal display illustrating signals from scan line driving circuit to a scan line, and from signal driving circuit to signal line according to conventional art.
Figure 3:
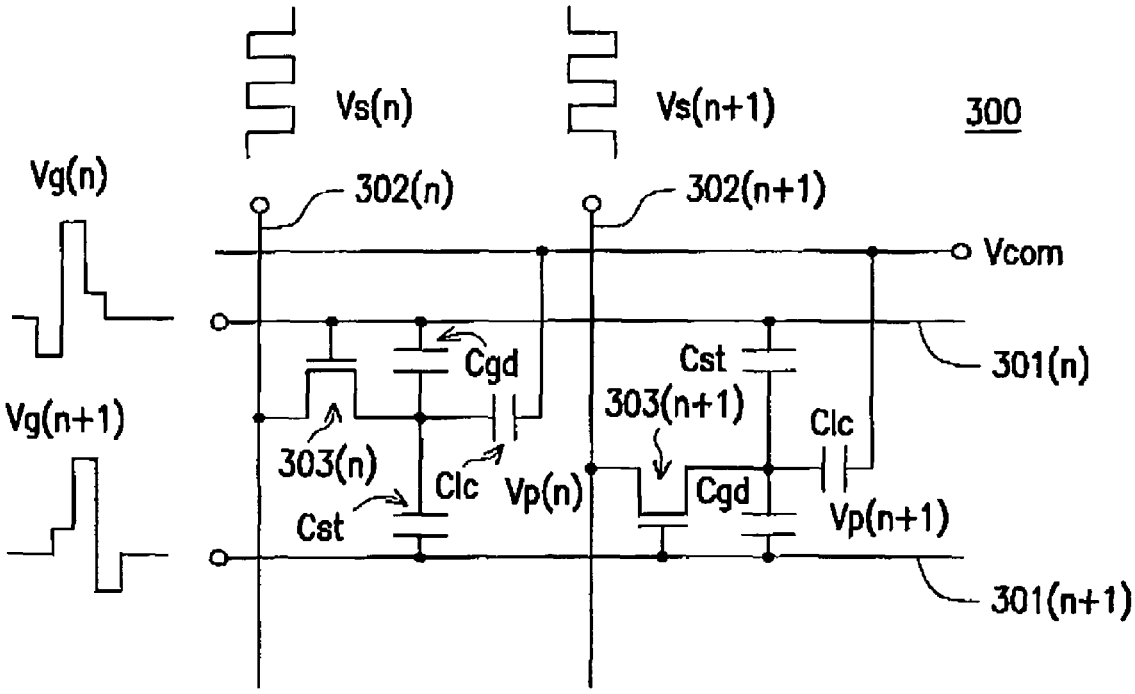
FIG. 3 (PRIOR ART)
FIG. 3 is a schematic structure diagram illustrating a liquid crystal display according to an embodiment of the present invention.
Figure 4:
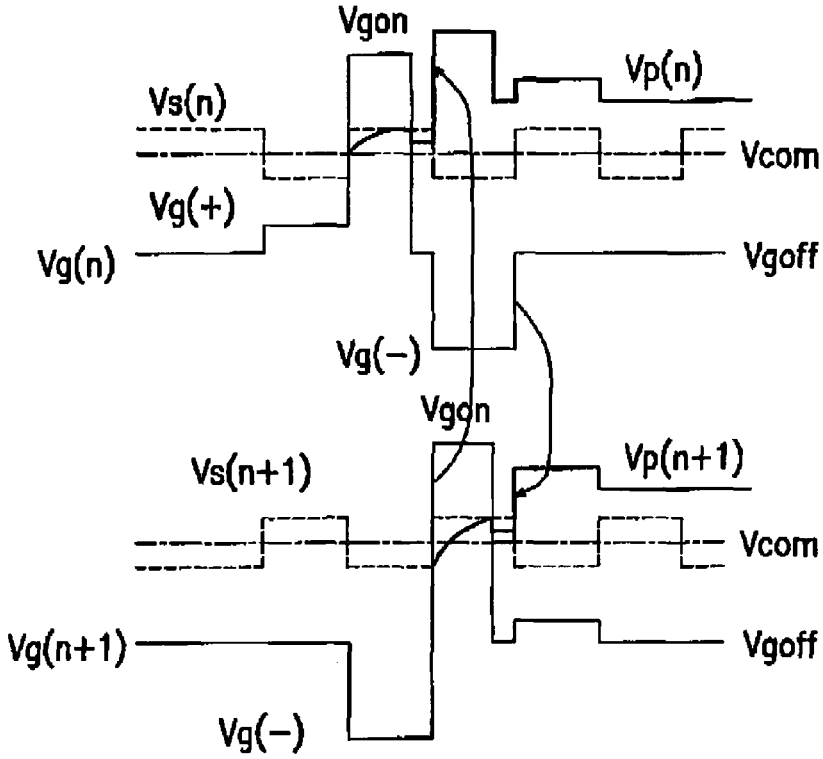
FIG. 4 (PRIOR ART)
FIG. 4 is a waveform diagram illustrating capacitive coupling method of the liquid crystal display structure according to FIG. 3.
Figure 5:
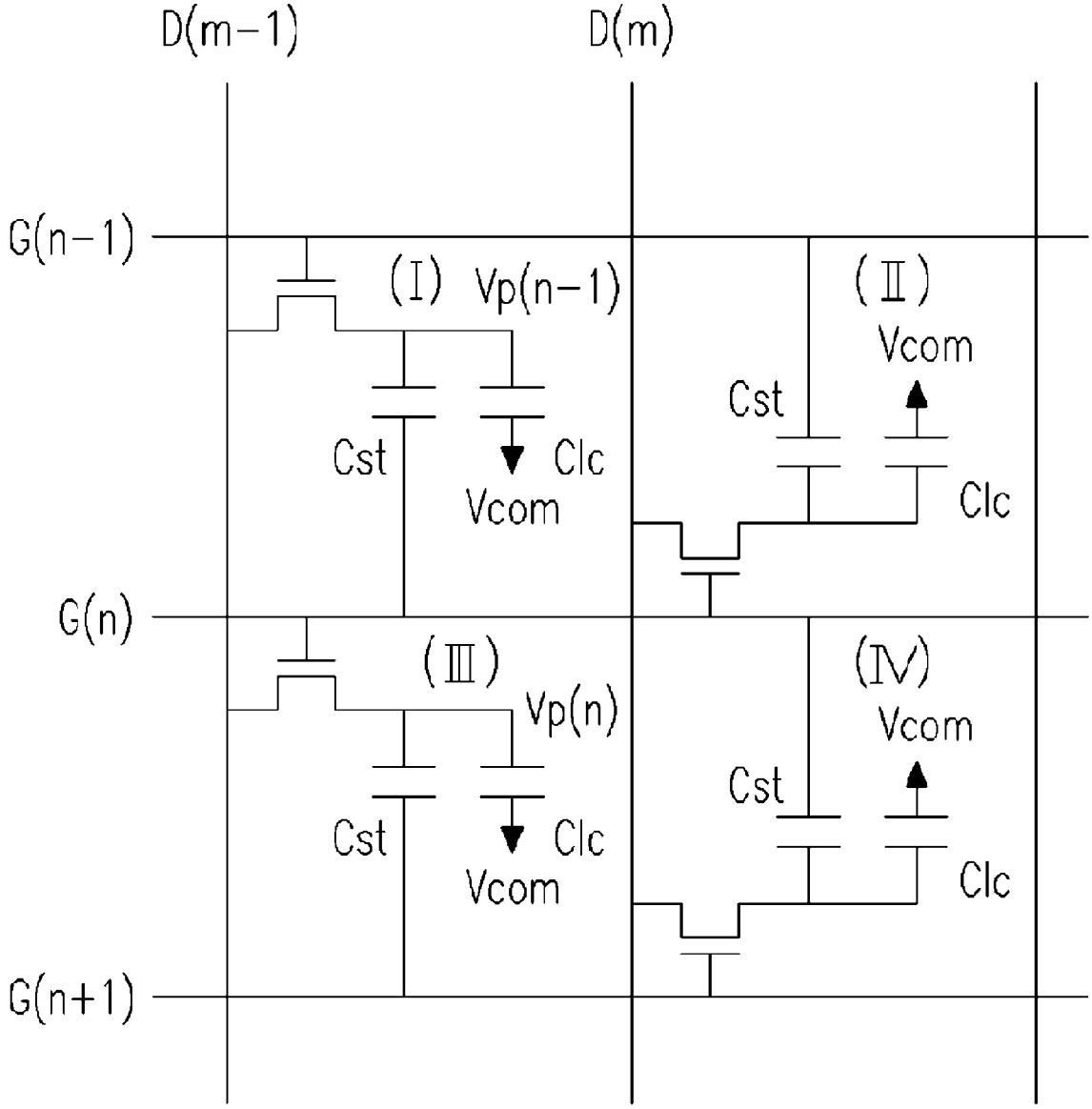
FIG. 5 is a schematic structure diagram of a liquid crystal display according to an embodiment of the present invention.

According to the first embodiment of the present invention, a driving method for a LCD is provided. Referring to FIG. 5, a LCD structure using the driving method according to one embodiment of the present invention is illustrated herein. The LCD structure includes scan lines G(n−1), G(n), and G(n+1), and signal lines D(m−1) and D(m). The corresponding pixels to the structured built with scan lines G(n−1), G(n), G(n+1) and signal lines D(m−1) and D(m) are pixel I, pixel II, pixel III, and pixel IV as illustrated in the figure.

Where a gate of the TFT of the pixel I is coupled to the scan line G(n−1), gates of the TFTs of the pixel II and III are coupled to the scan line G(n), and a gate of the TFT of the pixel IV is coupled to the scan line G(n+1). Sources of the TFTs of the pixel I and pixel III are coupled to the signal line D(m−1), and sources of the pixel II and pixel IV are coupled to the signal line D(m).

As illustrated in FIG. 5, for a same signal line, a storage capacitor of the pixel I is coupled to the gate of the TFT of the pixel III, and a storage capacitor of the pixel III is coupled to the gate of the TFT of the next stage pixel. A storage capacitor of the pixel IV is coupled to the gate of the TFT of the pixel II, and a storage capacitor of the pixel II is coupled to the gate of the TFT of the previous pixel. For description convenience, four pixels are exemplary herein, yet for the entire LCD structure, a plurality of pixels are included, where a gate of each of the pixels is coupled to a storage capacitor of a previous pixel on the same signal line, connected in a capacitively coupling fashion. Alternatively, a gate of each of the pixels is coupled to a storage capacitor of a next pixel on the same signal line, connected in a capacitively coupling fashion. A LCD array of the entire panel is arranged upon usage.

According to one aspect of the present invention, a scan line is biased with a pre-charge voltage, noted as $V_{pre}$ in the figure, before a scan signal is applied, i.e. before the TFT of the corresponding pixel of the LCD is switched on. Where $V_{pre}$ manages to change the voltage level of the signal line without switching on the TFT of the pixel thereof. The voltage $V_{pre}$ is capacitively coupled to a storage capacitor of a pixel belonging to a previous or a next stage that is coupled to the same signal line.

According to the embodiment of the present invention along with FIG. 5, the driving method includes biasing the voltage level of the pixel electrode to that of the common electrode, or similar to that of the common electrode, as noted $V_{com}$ in the figure. Therefore, edge blur of the images is avoided since black frame insertion can be implemented, i.e. hold type addressing method is applied to the LCD.

According to the embodiment of the present invention, the LCD structure illustrated in FIG. 5 manages to overdrive the liquid crystals therein and thus power consumption is reduced. Comparing to the method of biasing the voltage level of the pixel electrode to a similar voltage of the common electrode, a pre-charge voltage is biased to the pixel electrode for overdriving the pixel.

Figure 5A:
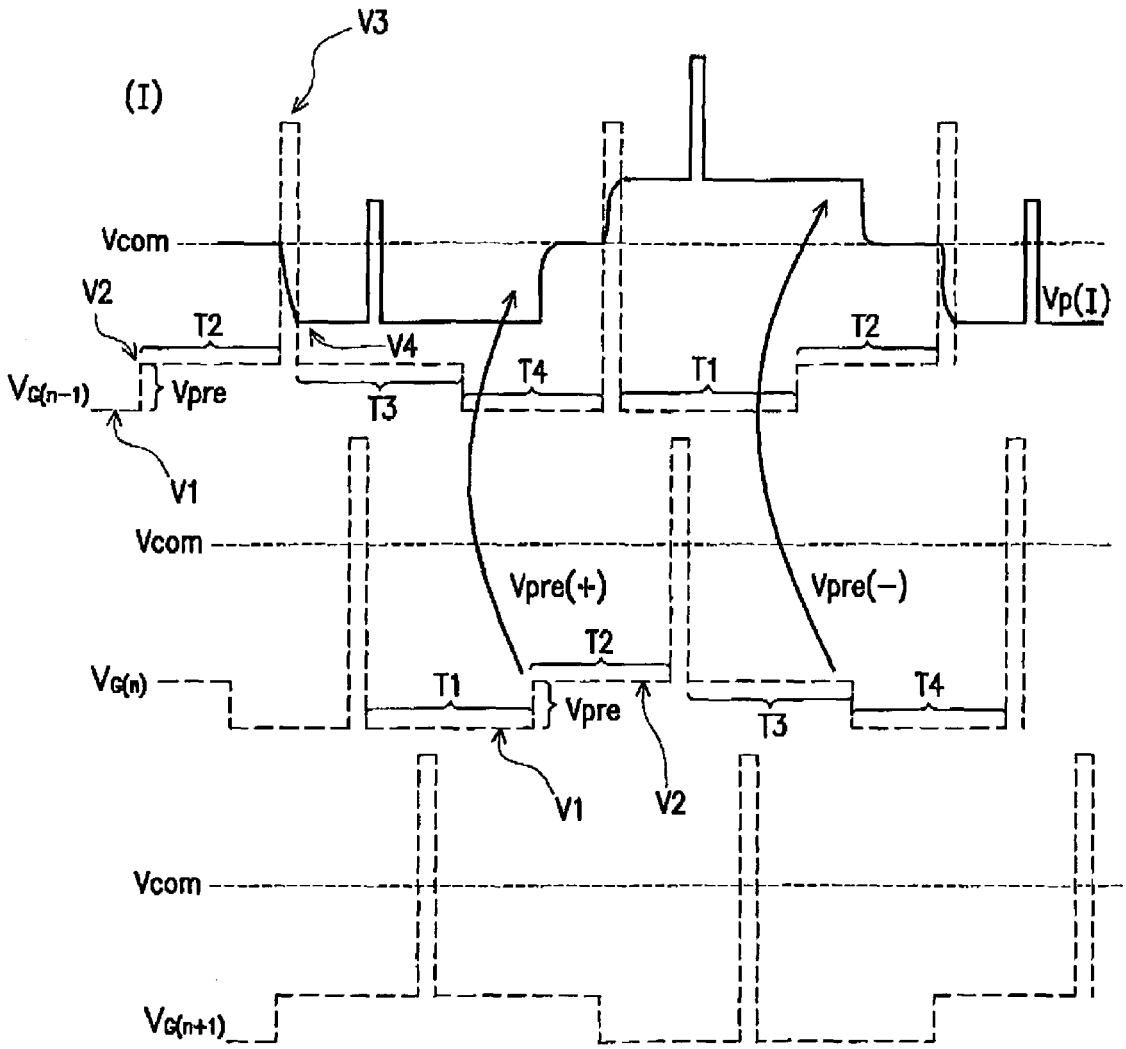
FIG. 5A to 5D are signal waveform diagrams of the liquid crystal display in FIG. 5 illustrating driving methods for pixel I, pixel II, pixel III, and pixel IV respectively according to one embodiment of the present invention.
Figure 5B:
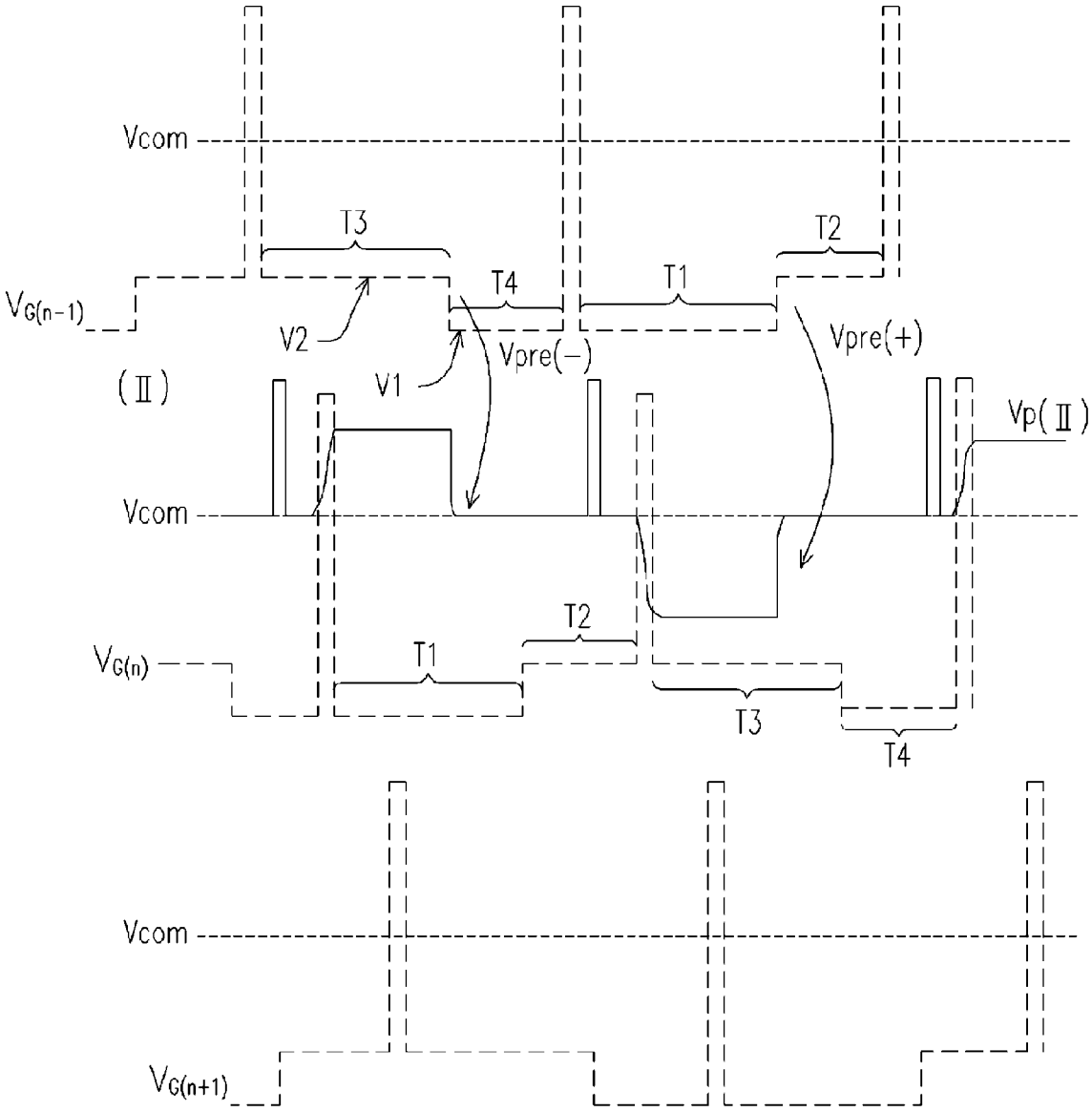
Figure 5C:
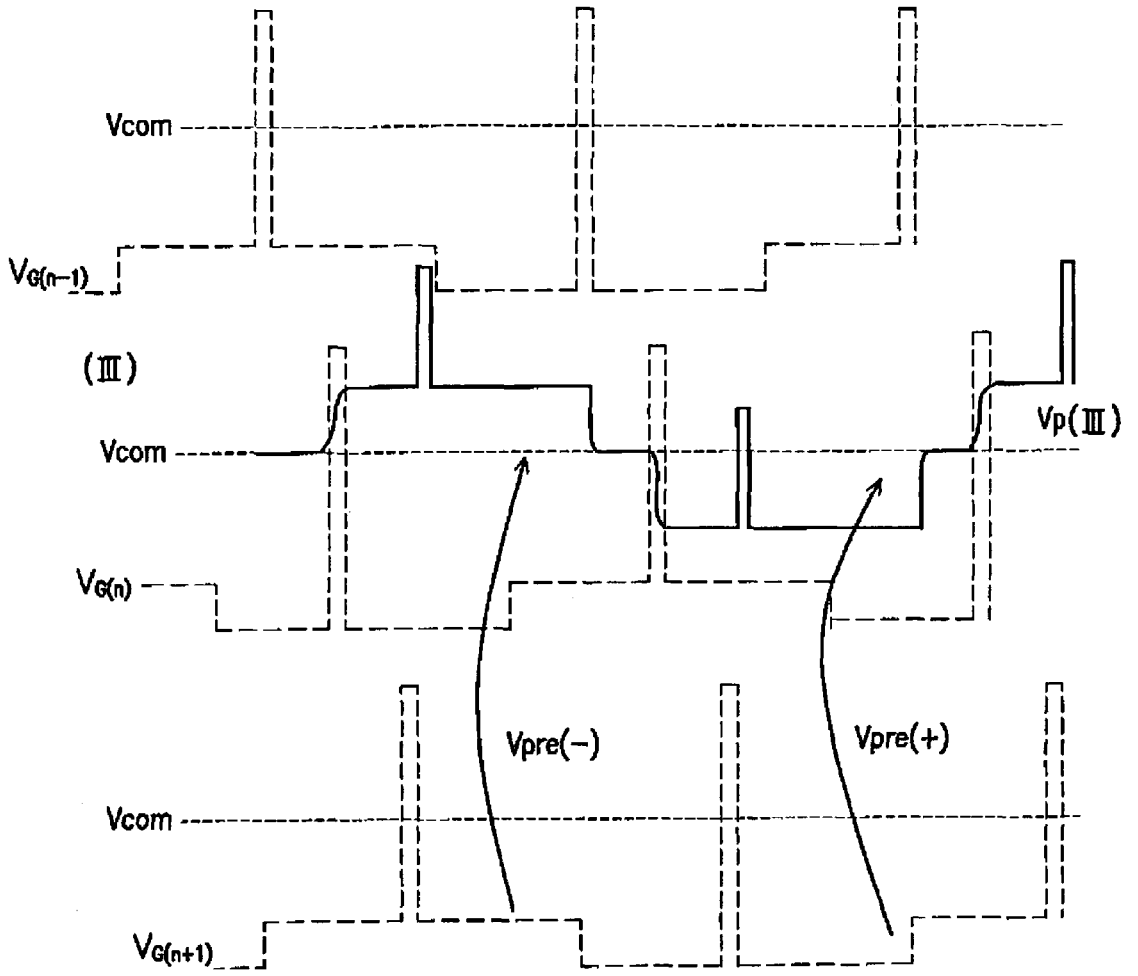
Figure 5D:
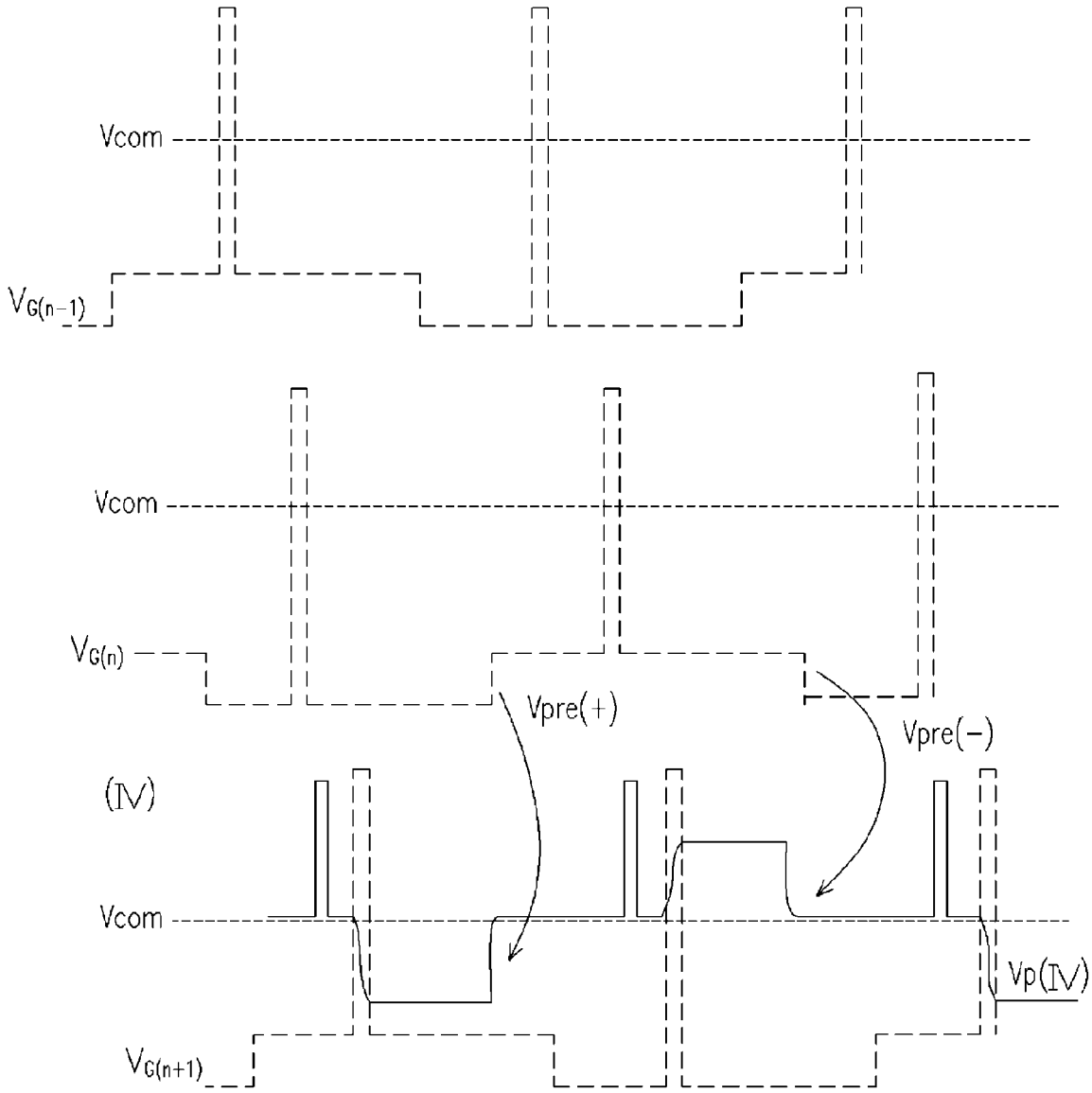

Referring to FIGS. 5A to 5D, schematic waveform diagram of driving methods for pixel I, pixel II, pixel III and pixel IV are illustrated. In the embodiment of the present invention, voltage value of the pixel electrode is biased to or close to that of the common voltage level $V_{com}$ such that black frame insertion is implemented. For description convenience, merely signal waveform diagrams of FIGS. 5A and 5D are described hereinafter, yet not limiting the scope of the present invention. First referring to FIG. 5A, voltage level of the pixel electrode that demonstrates capacitively coupling is illustrated. In FIG. 5B, voltage level of pixel electrode coupling via G(n−1) to the liquid crystal capacitor is additionally illustrated for description convenience. The driving method includes coupling the pixel voltage value via storage capacitor from previous stage or next stage of pixel that is coupled to the same scan line.

In FIG. 5A, a driving signal waveform of pixel I according to the driving method in one embodiment of the present invention is illustrated. A pre-charge voltage is coupled to the pixel electrode of pixel I via storage capacitor between next stage scan line and the pixel electrode thereof. Referring to FIG. 5A along with equivalent circuit in FIG. 5, the black solid line on top of the figure depicts voltage level of pixel electrode of pixel I, i.e. $V_p$(I) in the figure. And the thick dotted line is signal waveform of the scan line G(n−1). Hereinafter, the waveform of the signal of the scan line G(n) that affects the voltage level of the pixel electrode of pixel I is described. Signal waveforms of other scan lines are similar, thus are not further described.

Signal Waveform of the Scan Line G(n)

As the TFT of the pixel III is switched on, the scan line G(n) is kept at voltage level $V_1$ within the first time interval $T_1$. The scan line G(n) is firstly biased with a pre-charge voltage $V_{pre}$, where $V_{pre}$ changes the voltage level $V_{G(n)}$ of the scan line G(n) from $V_1$ to $V_2$, yet not manages to switch on the TFT thereof pixel III. The scan line G(n) is then biased with a scan voltage after a second time interval $T_2$, such that $V_{G(n)}$ changes from $V_2$ to $V_3$, and TFT of the pixel is switched on thereafter. The voltage level of the pixel I that is neighboring to pixel III changes from $V_{com}$ to $V_4$. Biasing the voltage level $V_{G(n)}$ back to $V_2$ for a time interval $T_3$, then back to voltage level $V_1$ for a time interval $T_4$ before switching on the TFT of the pixel III next time.

Voltage Level of the Pixel Electrode of Pixel I

According to the above description, the storage capacitor of pixel I is coupled to the gate of the TFT of pixel III on a same signal line D(m−1), and the storage capacitor of the pixel III is coupled to a gate of the TFT of the next stage. Therefore, a signal waveform of the voltage level of pixel III on scan line G(n) is demonstrated as middle part of FIG. 5A. Since the storage capacitor of pixel I is coupled to a gate of the TFT of pixel III, the voltage level $V_{G(n)}$ of the scan line G(n) is change from $V_1$ to $V_2$ when the scan line G(n) is biased with the pre-charge voltage $V_{pre}$ and kept for a second time interval, yet the TFT thereof is not switched on. As the first arrow shown on left side of the figure, the pre-charge voltage $V_{pre}$ is capacitively feedback coupled to the pixel electrode of the pixel. Since the current pixel I is in negative filed, the pixel electrode is biased with the pre-charge voltage $V_{pre}$ in a positive value, i.e. $V_{pre}$(+) as shown in FIG. 5A for biasing pixel electrode to the voltage level $V_4$, or close to the common electrode $V_{com}$.

The second time interval $T_2$ is the timing for black frame insertion. The duration of black frame insertion is about 30% of the entire frame according to the embodiment of the present invention, where the frame duration is a time length that is needed for scanning all scan lines of the LCD structure once. This scheme can be modified upon design requirement.

Thereinafter, when the polarity is flipped, as the second arrow of on right of the figure shows, when the voltage level of the pixel electrode of pixel I is larger than that of the common electrode $V_{com}$, $V_{G(n)}$ is changed from the scan signal to a voltage level $V_2$ in pixel III, and changed back to $V_1$ after the third time interval $T_3$, and retained for a fourth time interval $T_4$. When $V_{G(n)}$ is changed from $V_2$ to $V_1$, the pre-charge voltage $V_{pre}$ is coupled to the pixel electrode via the storage capacitor between the scan line G(n) and the pixel electrode of pixel I. Since current pixel I is on positive field, the pixel electrode is biased with a negative $V_{pre}$, i.e. $V_{pre}$(−) as depicted in FIG. 5A for biasing the voltage level of the pixel electrode back to or close to that of the common electrode, when is the time to insert black frame.

According to the above description of the embodiment, if a gate of each of the pixels of a LCD structure is capacitively coupled to the storage capacitor of a neighboring pixel along a same signal line, the time when biasing the scan line of the neighboring pixel with a pre-charge voltage $V_{pre}$, i.e. the second time interval $T_2$ as depicted in the figure, or the starting time of the fourth time interval $T_4$, is ahead of the time when the TFT of the capacitively coupled pixel is switched on. The pixel electrode is pre-charged with the voltage $V_{pre}$ via the storage capacitor thereafter, where $V_{pre}$ being positive or negative voltage level is determined by polarity.

For pre-charging the pixel electrode of pixel I with the voltage $V_{pre}$ via the scan line G(n) an storage capacitor, the coupling voltage value, i.e. the variation of the voltage of the pixel electrode as pre-charging with $V_{pre}$ is $(C_{st}/C_{total})\cdot V_{pre}$ in the embodiment, where $C_{st}$ is the storage capacitance of pixel I, and $C_{total}$ is the total capacitance of the pixel electrode. That is, the voltage level variation of the pixel electrode is dependent on the pre-charge voltage $V_{pre}$ as featured.

According to the embodiment of the present invention, the time intervals $T_1$, $T_2$, $T_3$ and $T_4$ are customized individually. For biasing time with capacitively coupling method, that is the second time interval $T_2$ and the fourth time interval $T_4$ as depicted in the figure are set up as featured. According to the relevance between voltage level of the pixel electrode of pixel I affected by the voltage level of the scan line G(n) in a positive field or a negative field, a dot inversion driving method is used in the embodiment.

An identical driving method and description thereof is suitable for signal waveform diagrams illustrated in FIGS. 5B to 5D. A driving signal waveform diagram of pixel III in FIG. 5C is identical to FIG. 5A, thus is omitted herein.

A driving signal waveform diagram for pixel II is depicted in FIG. 5B, and a driving signal waveform diagram for pixel IV is depicted in FIG. 5D. In FIG. 5B, a gate of each of the pixels of the LCD array is capacitively coupled to the storage capacitor of a next stage pixel along the same signal line as depicted on right side of FIG. 5. Therefore the time a scan line of a previous stage pixel is pre-charged is ahead of the time when the TFT of the capacitively coupled pixel is switched on for next data writing, when the pixel is pre-charged with the voltage $V_{pre}$ for adjusting the voltage level thereof, depicted as $V_p$(II) in the figure. Applying a negative pre-charge voltage $V_{pre}$(−) is depicted as left hand arrow in FIG. 5B, whereas a positive pre-charge voltage $V_{pre}$(+) is depicted as right hand arrow in FIG. 5B.

When the voltage level of the pixel electrode is adjusted back to or close to that of the common electrode, black frame is inserted. The duration of the black frame is about 30% of the frame in the embodiment of the present invention, yet can be adjusted as featured. A driving signal waveform diagram of pixel IV in FIG. 5D is similar to that of FIG. 5B, hence description thereof is skipped herein.

The Second Embodiment

In another embodiment of the present invention, a scan line is pre-charged with a voltage $V_{pre}$ for a feedback time interval T before a scan line of the LCD is biased with a scan signal, where voltage variation caused by the voltage $V_{pre}$ does not manage to switch on the TFT thereof. The voltage $V_{pre}$ is capacitively coupled to a pixel voltage of a previous or a next stage pixel that is coupled to the same scan line via a storage capacitor. For example, in the embodiment of the present invention along with description in FIG. 6, the voltage level of the pixel electrode is biased to or similar to that of the common electrode, i.e. $V_{com}$.

Figure 6:
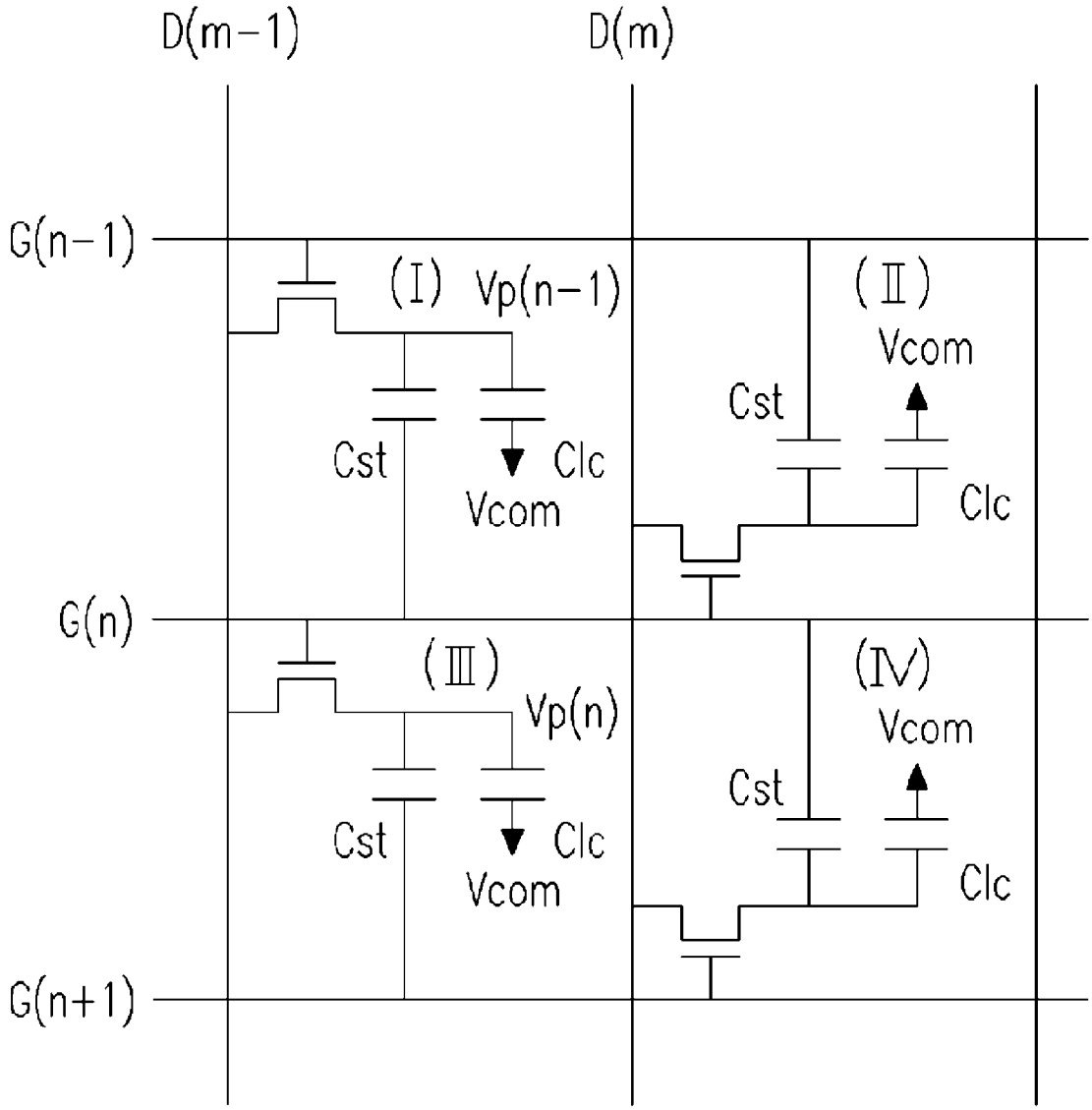
FIG. 6 is a schematic structure diagram illustrating a liquid crystal display according to an embodiment of the present invention.

Referring to FIG. 6, the LCD structure includes scan lines G(n−1), G(n), and G(n+1), and signal lines D(m−1) and D(m). The corresponding pixels to the structured built with scan lines G(n−1), G(n), G(n+1) and signal lines D(m−1) and D(m) are pixel I, pixel II, pixel III, and pixel IV as illustrated in the figure. Where a gate of the TFT of the pixel I is coupled to the scan line G(n−1), gates of the TFTs of the pixel II and III are coupled to the scan line G(n), and a gate of the TFT of the pixel IV is coupled to the scan line G(n+1). Sources of the TFTs of the pixel I and pixel III are coupled to the signal line D(m−1), and sources of the pixel II and pixel IV are coupled to the signal line D(m).

The hereby difference with that of FIGS. 5A to 5D is after biasing the scan line with the pre-charge voltage Vpre for a feedback time interval T, the voltage level of the scan line returns to an original level, that is the voltage level before pre-charged. The featuring feedback time interval T in the embodiment of the present invention is reserved for black frame insertion.

Referring to FIGS. 6A to 6D, schematic waveform diagram of driving methods for pixel I, pixel II, pixel III and pixel IV are illustrated. First referring to FIG. 6A, a signal waveform diagram of pixel I is illustrated herein. The black solid line on top of the figure depicts voltage level of pixel electrode of pixel I, i.e. $V_p$(I) in the figure. And the thick dotted line is signal waveform of the scan line G(n−1). Hereinafter, the waveform of the signal of the scan line G(n) that affects the voltage level of the pixel electrode of pixel I is described. Signal waveforms of other scan lines are similar, thus are not further described.

Signal Waveform of the Scan Line G(n)

As the TFT of the pixel III is switched on, the scan line G(n) is pre-charged with a voltage $V_{pre}$ biasing from a voltage level $V_1$ to $V_2$ within the first time interval $T_1$, where $V_{pre}$ does not manages to switch on the TFT thereof. The pre-charge voltage $V_{pre}$ is retained within a certain time interval, and the time interval is featured as desired yet is ended before the TFT of pixel III is switched on next time. For example, in the embodiment of the present invention, if a black frame is to be inserted, the first feedback time interval $T_1$ is about 30% of the field, which can be adjusted as desired. The difference between herein and that of FIGS. 5A to 5D is the scan line G(n) is biased with a pre-charge voltage $V_{pre}$ and returns to original voltage level $V_1$ after the timer interval.

Thereinafter, biasing the scan line G(n) with the scan signal voltage for switching on the TFTs of the pixel III. As the scan line G(n) returns to the voltage level $V_1$ and halts for a period of time. The scan line G(n) is biased with a pre-charge voltage $V_{pre}$ from voltage level $V_1$ to $V_5$ within a second feedback interval $T_2$. The pre-charge voltage $V_{pre}$ is only retained within a specific time interval featured as desired yet is ended before the TFT of pixel III is switched on next time.

Voltage Level of the Pixel Electrode of Pixel I

Figure 6A:
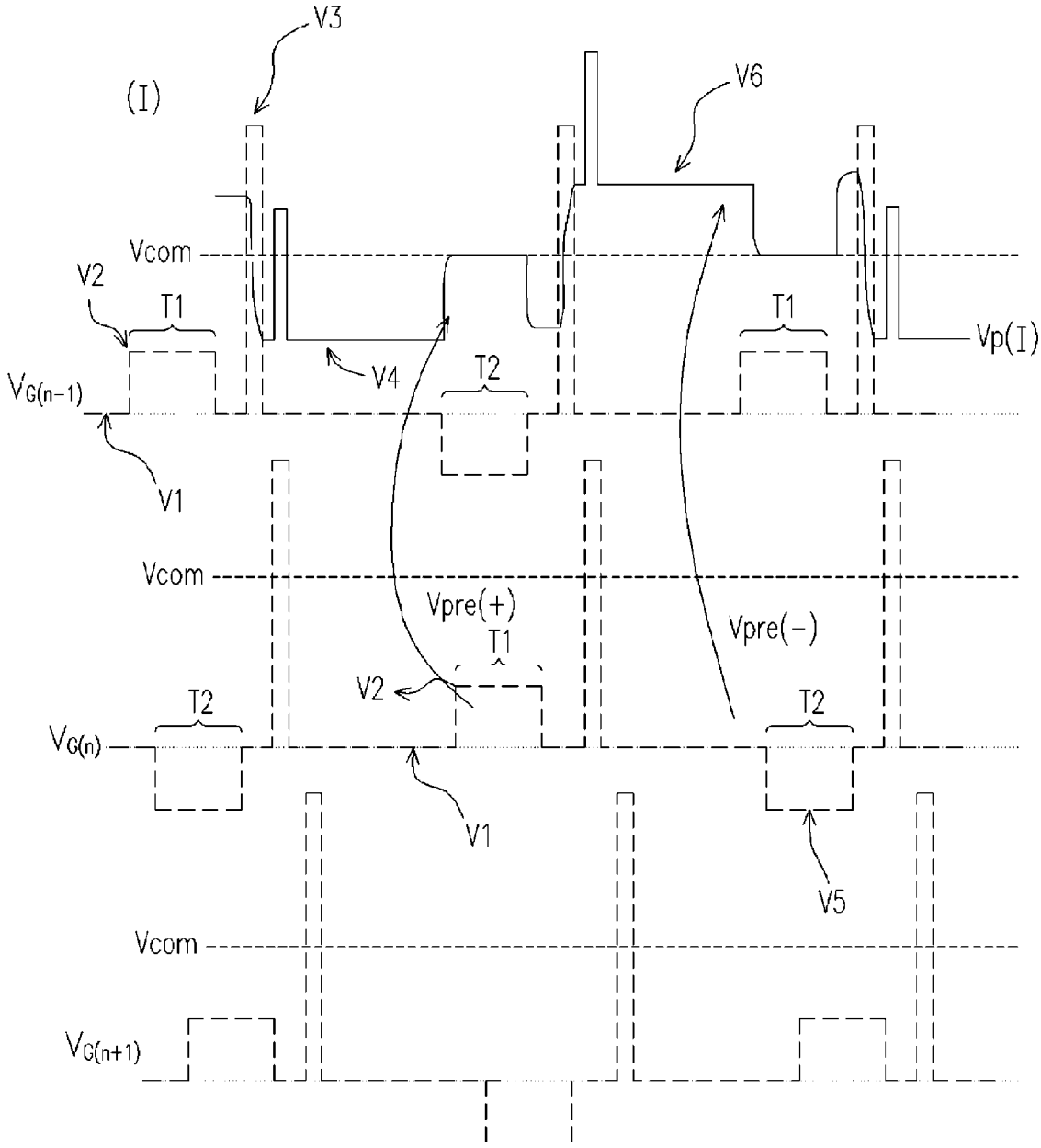
FIG. 6A to 6D are signal waveform diagrams of the liquid crystal display in FIG. 6 illustrating driving methods for pixel I, pixel II, pixel III, and pixel IV respectively according to one embodiment of the present invention.

According to the foregoing description, along the same signal line D(m−1), the storage capacitor of pixel I is coupled to a gate of the TFT of pixel III, and the storage capacitor of pixel Iii is also coupled to a gate of the TFT of a next stage pixel. Therefore, the signal waveform of the scan line G(n) of pixel III is depicted as the middle part of FIG. 6A. Since the storage capacitor of pixel I is coupled to the gate of TFT of pixel III, when the scan line is pre-charged with $V_{pre}$ within a first feedback time interval $T_1$, i.e. when the voltage level $V_{G(n)}$ of the scan line G(n) is biased from voltage level $V_1$ to $V_2$, the Vpre is capacitively feedback coupled to the pixel electrode of pixel I via the storage capacitor as the first arrow symbol on left side of the figure. When pixel I is on negative field, the voltage level $V_4$ of the pixel electrode of pixel I is smaller than the voltage level $V_{com}$ of the common electrode. The pixel electrode is thus biased with a positive pre-charge voltage $V_{pre}$, i.e. $V_{pre}$(+) as depicted in FIG. 6A so as to bias the voltage level of the pixel electrode from $V_5$ back to or close to that of the common electrode, when is the time for black frame insertion.

Thereinafter, when the polarity is flipped, as the second arrow of on right of the figure shows, when the voltage level $V_6$ of the pixel electrode of pixel I is larger than that of the common electrode $V_{com}$, scan line G(n) is biased with a pre-charge voltage $V_{pre}$ for a time interval T, i.e. $V_{G(n)}$ is changed from a voltage level $V_1$ to a voltage level $V_5$, when the pre-charge voltage $V_{pre}$ is coupled to the pixel electrode via the storage capacitor between the scan line G(n) and the pixel electrode of pixel I. Since current pixel I is on positive field, the pixel electrode is biased with a negative $V_{pre}$, i.e. $V_{pre}$(−) as depicted in FIG. 6A for biasing the voltage level $V_6$ of the pixel electrode back to or close to the voltage level $V_{com}$ of the common electrode, when is the time to insert black frame.

According to the embodiment of the present invention, the time intervals $T_1$ and $T_2$ are customized individually. For biasing time with capacitively coupling method, that is the first time interval $T_1$ and the second time interval $T_2$ as depicted in the figure are set up as featured. According to the relevance between voltage level of the pixel electrode of pixel I affected by the voltage level of the scan line G(n) in a positive field or a negative field as illustrated in FIG. 6A, a dot inversion driving method is used in the embodiment.

Figure 6B:
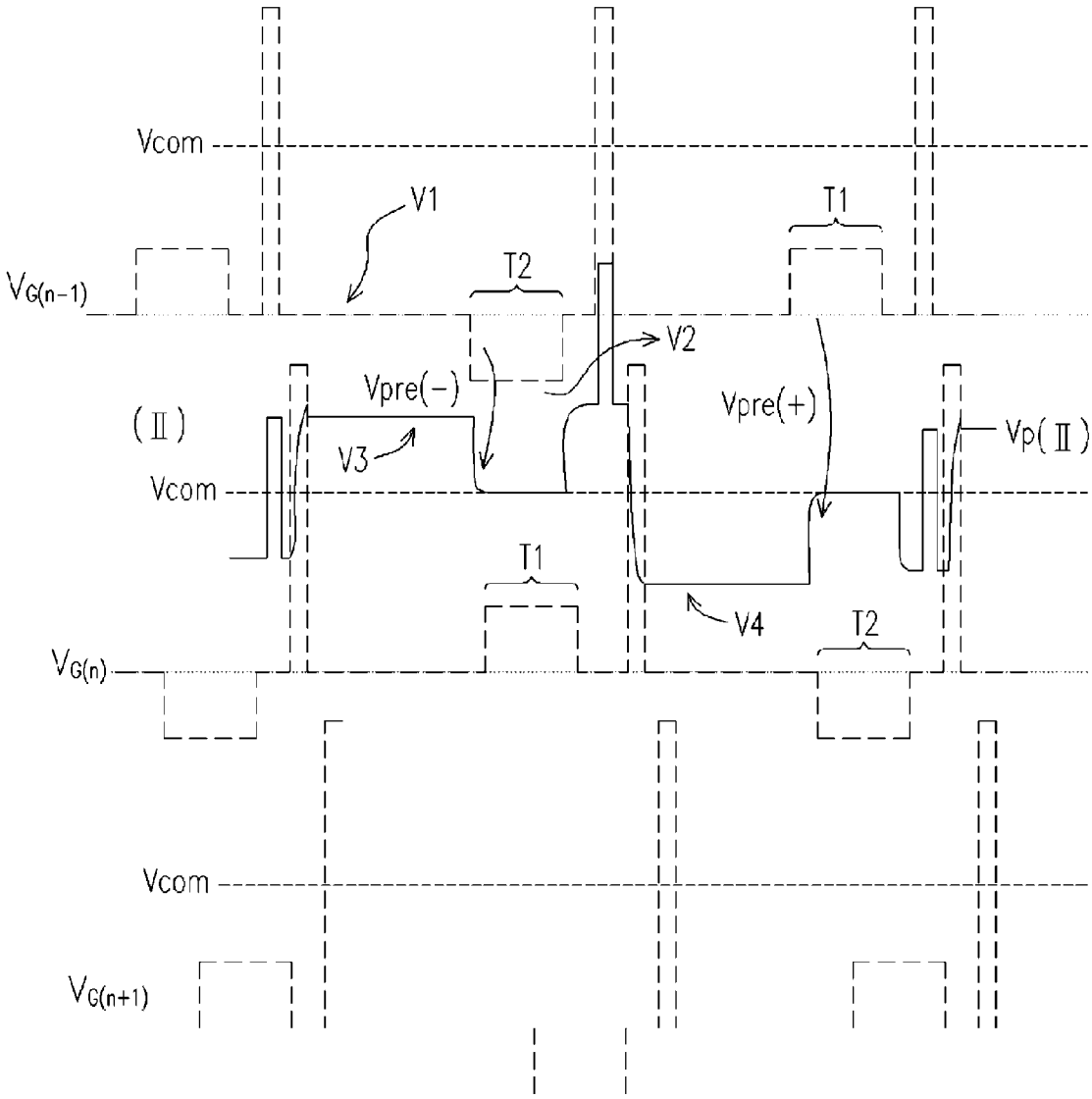
Figure 6C:
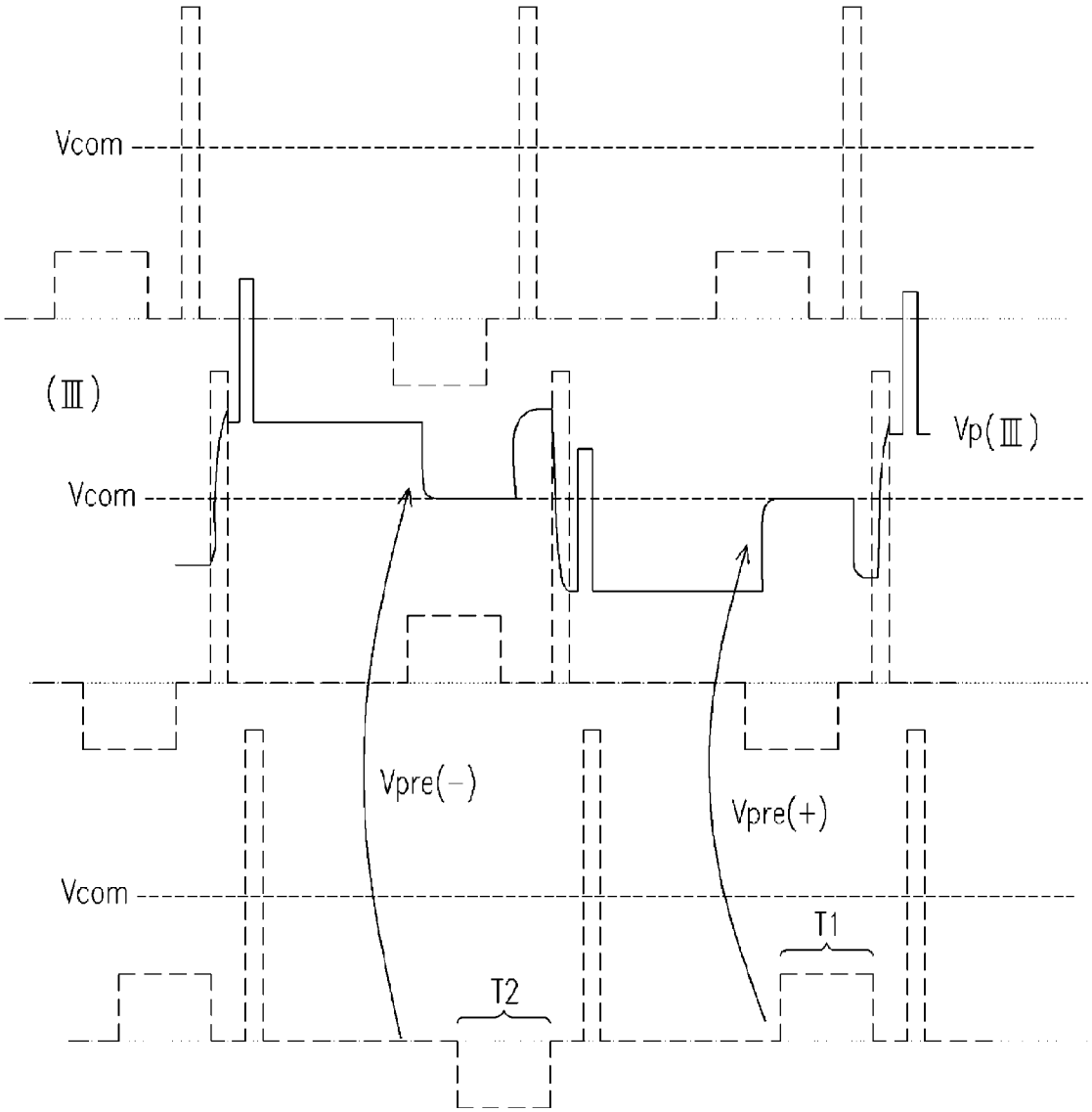
Figure 6D:
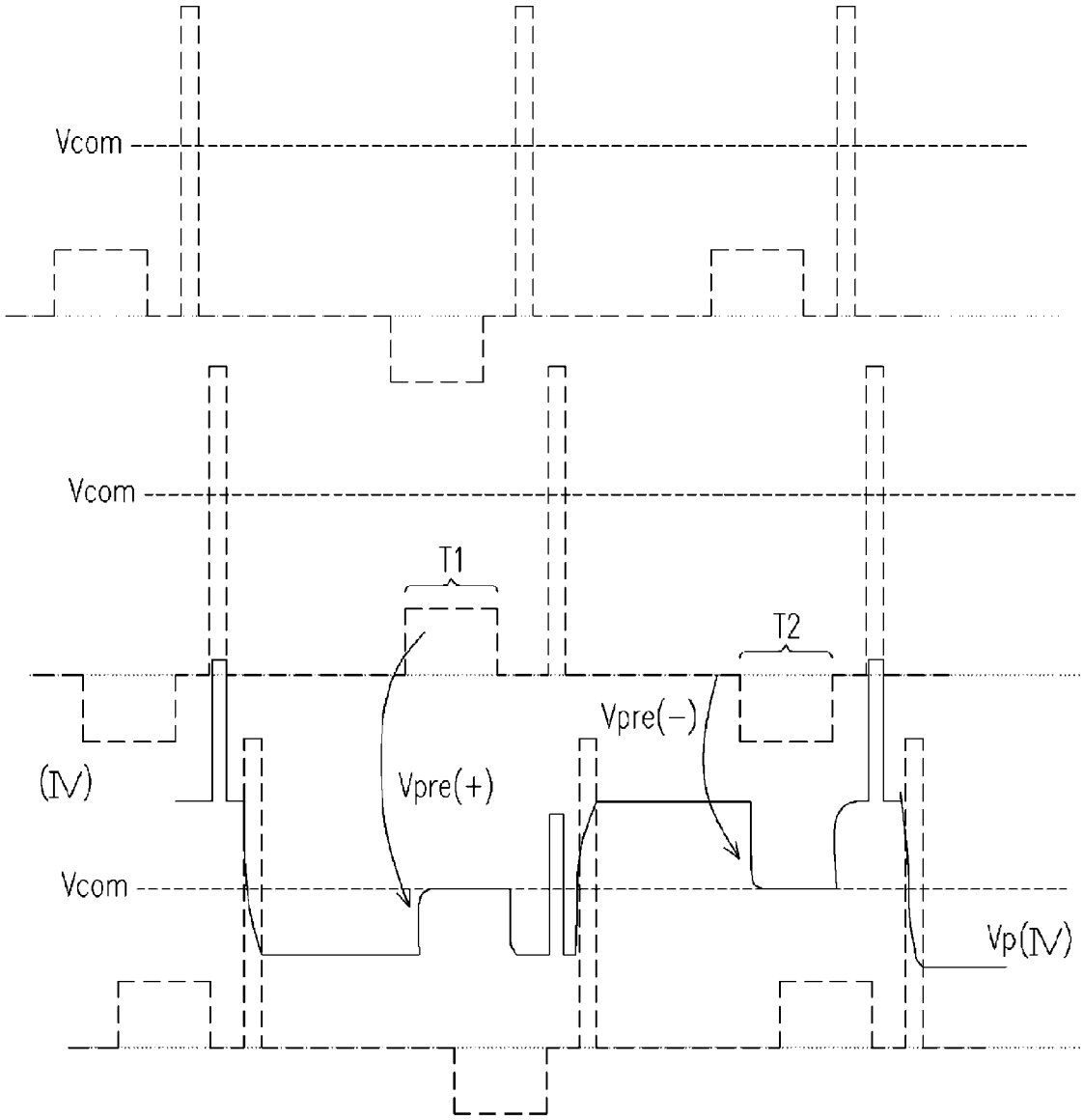

An identical driving method and description thereof is suitable for signal waveform diagrams illustrated in FIGS. 6B to 6D. A driving signal waveform diagram of pixel III in FIG. 6C is identical to FIG. 6A, thus is omitted herein.

A driving signal waveform diagram for pixel II is depicted in FIG. 6B, and a driving signal waveform diagram for pixel IV is depicted in FIG. 6D. In FIG. 6B, a gate of each of the pixels of the LCD array is capacitively coupled to the storage capacitor of a next stage pixel along the same signal line as depicted on right side of FIG. 6. Therefore, a scan line of a previous stage is biased with a pre-charge voltage $V_{pre}$ for a feedback time interval T. That is, when the voltage level of the scan line is biased from voltage level $V_1$ to $V_2$, the pixel electrode is biased with the pre-charge voltage $V_{pre}$ before the TFT of the pixel that is capacitively coupled to the scan line is ready for next data writing. When pixel II is on a positive filed, the pixel electrode is biased with a negative pre-charge voltage value $V_{pre}$, i.e. $V_{pre}(-)$ depicted as left hand arrow in FIG. 6B for biasing the voltage level of the pixel electrode from voltage level $V_3$ back to or close to the voltage level $V_{com}$ of the common electrode. Whereas the pixel electrode is biased with a positive pre-charge voltage $V_{pre}(+)$ when the pixel II is on negative filed, for biasing the voltage level of the pixel electrode from the voltage level $V_4$ back to or close to the voltage level $V_{com}$ of the common electrode.

When the voltage level of the pixel electrode is adjusted back to or close to that of the common electrode, black frame is inserted. The duration of the black frame is about 30% of the frame in the embodiment of the present invention, yet can be adjusted as featured. A driving signal waveform diagram of pixel IV in FIG. 6D is similar to that of FIG. 6B, hence description thereof is skipped herein.

The Third Embodiment

Figure 7:
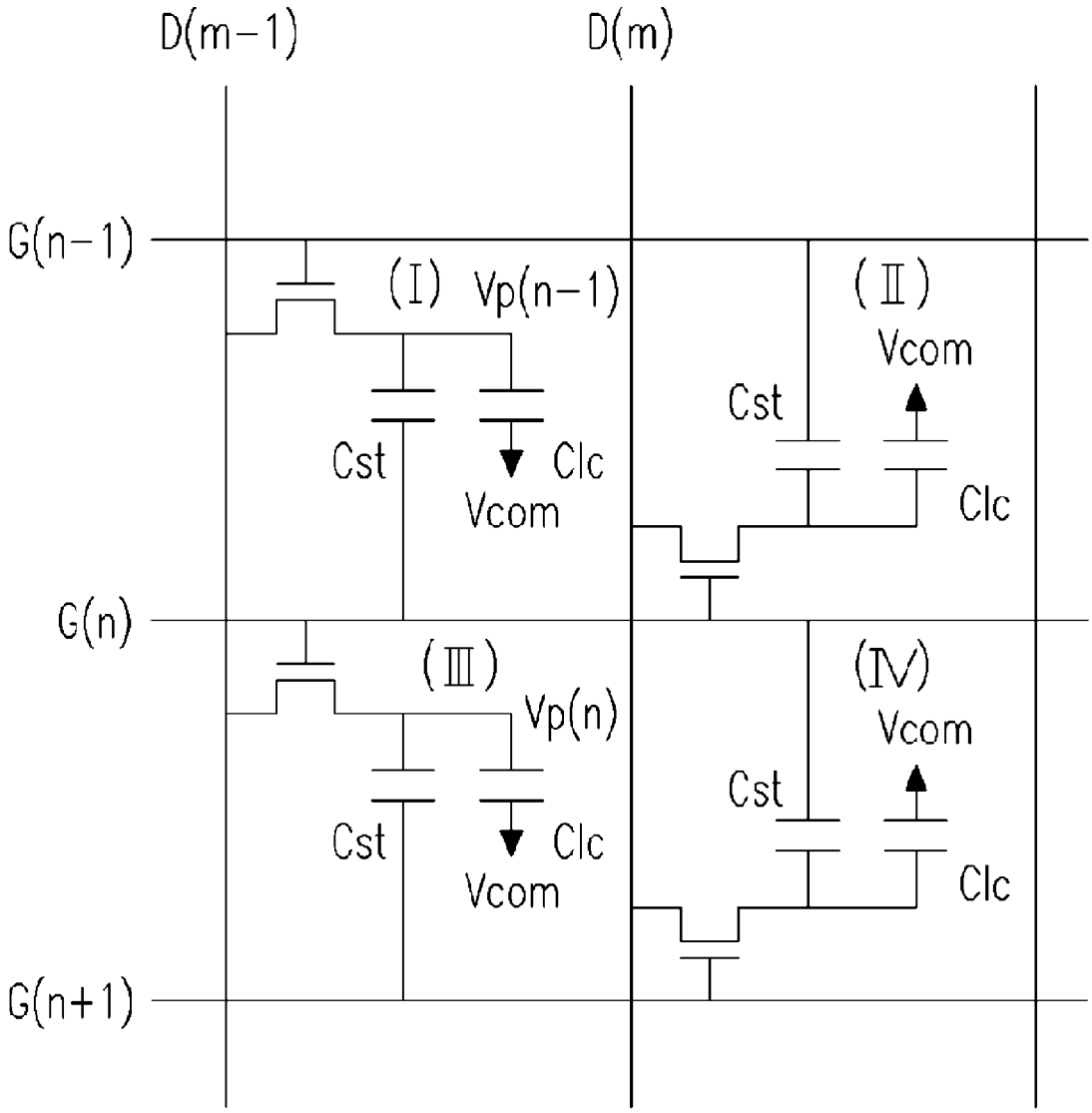
FIG. 7 is a schematic structure diagram illustrating a liquid crystal display according to an embodiment of the present invention.

In another embodiment of the present invention, a driving method with liquid crystal overdrive and reduced power consumption is provided as illustrated in FIG. 7. Referring to FIG. 7, the LCD structure includes scan lines G(n−1), G(n), and G(n+1), and signal lines D(m−1) and D(m). The corresponding pixels to the structured built with scan lines G(n−1), G(n), G(n+1) and signal lines D(m−1) and D(m) are pixel I, pixel II, pixel III, and pixel IV as illustrated in the figure. Where a gate of the TFT of the pixel I is coupled to the scan line G(n−1), gates of the TFTs of the pixel II and III are coupled to the scan line G(n), and a gate of the TFT of the pixel IV is coupled to the scan line G(n+1). Sources of the TFTs of the pixel I and pixel III are coupled to the signal line D(m−1), and sources of the pixel II and pixel IV are coupled to the signal line D(m).

Referring to FIGS. 7A to 7D, schematic waveform diagrams of driving methods for pixel I, pixel II, pixel III and pixel IV are illustrated. In the embodiment of the present invention, comparing to the method of biasing the voltage level of the pixel electrode back to or close to that of the common electrode, in the embodiment the pre-charge voltage is further increased when the voltage level of the pixel is higher than the voltage level $V_{com}$ of the common electrode, such that the pixel is overdriven and power consumption is reduced. If the pixel is on a negative field, the voltage level of the pixel electrode is lower than the voltage level $V_{com}$ of the common electrode, thus the pre-charge voltage is further reduced for overdriving the pixel and reducing power consumption.

Figure 7A:
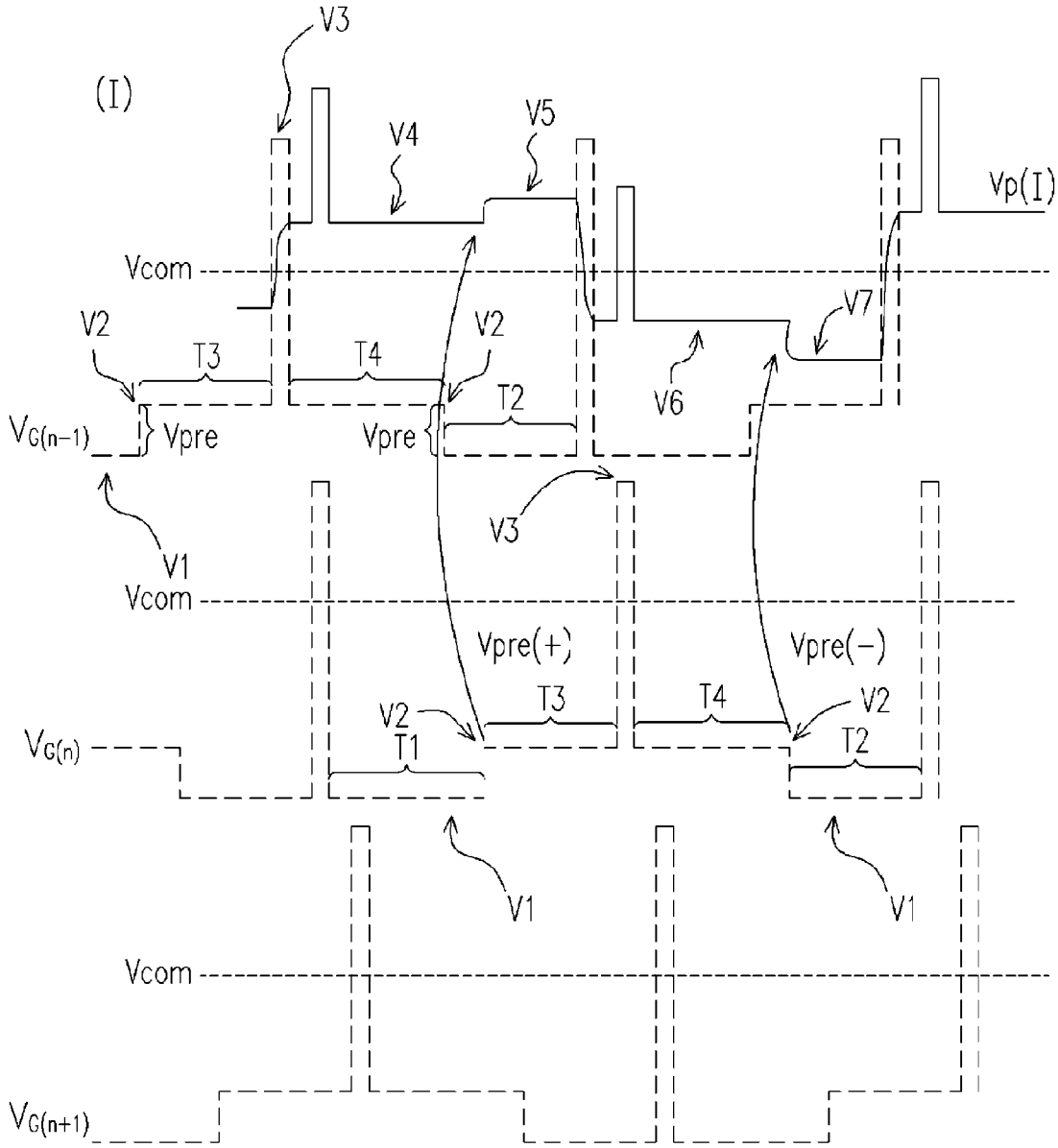
FIG. 7A to 7D are signal waveform diagrams of the liquid crystal display in FIG. 7 illustrating driving methods for pixel I, pixel II, pixel III, and pixel IV respectively according to one embodiment of the present invention.

Referring to FIG. 7A, a signal waveform diagram of pixel I is illustrated herein. The black solid line on top of the figure depicts voltage level of pixel electrode of pixel I, i.e. $V_p(I)$ in the figure. And the thick dotted line is signal waveform of the scan line G(n−1). Hereinafter, the waveform of the signal of the scan line G(n) that affects the voltage level of the pixel electrode of pixel I is described. Signal waveforms of other scan lines are similar, thus are not further described.

Signal Waveform of the Scan Line G(n)

Referring to middle part of FIG. 7A, as the TFTs of pixel I is switched on and as the TFTs of the pixel III is switched on, the scan line G(n) is pre-charged with a voltage $V_{pre}$ biasing from a voltage level $V_1$ to $V_2$ within the first time interval $T_1$, where $V_{pre}$ does not manages to switch on the TFT thereof. The scan line G(n) is again biased with a pre-charge voltage such that $V_{G(n)}$ is biased from voltage level $V_2$ to voltage level $V_3$, for switching on all TFTs of the pixel. The voltage level $V_{G(n)}$ of the scan line G(n) is then changed from $V_3$ to $V_2$ retaining for a time interval $T_4$, and change from $V_2$ to $V_1$ retaining for a time interval $T_2$.

Voltage Level of the Pixel Electrode of Pixel I

According to the foregoing description, along the same signal line D(m−1), the storage capacitor of pixel I is coupled to a gate of the TFT of pixel III, and the storage capacitor of pixel Iii is also coupled to a gate of the TFT of a next stage pixel. Therefore, the signal waveform of the scan line G(n) of pixel III is depicted as the middle part of FIG. 7A. Since the storage capacitor of pixel I is coupled to the gate of TFT of pixel III, when the scan line is pre-charged with $V_{pre}$, the $V_{pre}$ is capacitively feedback coupled to the pixel electrode of pixel I via the storage capacitor as the first arrow symbol on the left side of the figure. Thus the voltage level of the pixel electrode of pixel I is increased from $V_4$ to $V_5$, which differs from $V_{com}$ even further, where the variation amount is featured as desired. For example, the variation amount is $(C_{st}/C_{total})\cdot V_{pre}$, where $C_{st}$ is the storage capacitance of pixel I and $C_{total}$ is the total capacitance of the pixel electrode of pixel I. That is, the amount of voltage level variation of the pixel electrode is featured with the pre-charge voltage $V_{pre}$ as desired.

Different from black frame insertion, the increasing time of the voltage level of the pixel electrode is hundreds to thousands times longer than that of the voltage level remained unchanged. For example, the increasing time of the voltage level of the pixel electrode is in millisecond order (ms), the time of that remaining unchanged is in microsecond (μs) order. Of course the difference can be modified upon request. That is, as the TFT of the pixel III is switched on, the scan line G(n) is biased with a pre-charge voltage $V_{pre}$ for a time interval $T_1$ such that voltage level $V_{G(n)}$ is increased from $V_1$ to $V_2$, and remaining for a third time interval $T_3$. Where the time interval $T_3$ is far longer than the time interval $T_1$. For example, if the time interval $T_3$ is in millisecond order, the time interval $T_1$ is in microsecond order, differed from hundreds to thousands of times.

Thereinafter, when the polarity is flipped, as the second arrow of on right of the figure shows, when the voltage level of the pixel electrode of pixel I is smaller than the voltage level $V_{com}$ of the common electrode, the voltage level $V_{G(n)}$ of the scan line G(n) is biased from a voltage level $V_2$ to $V_1$. When the pre-charge voltage $V_{pre}$ is coupled to the pixel electrode of pixel I via the storage capacitor, such that voltage level of the pixel electrode is changed from $V_6$ to $V_7$ differed from $V_{com}$ by further more.

According to the above description, if a gate of each of the pixels of the LCD is coupled to a storage capacitor of a previous stage pixel along a same signal line in a capacitively coupling fashion. The time when the scan line is pre-charged with the voltage Vpre is after the data written in the TFTs of the pixel that is capacitively coupled to the scan line, and within a short time interval after the TFT of the pixel is switched on. Referring to FIG. 7A, after the TFTs of pixel I are switched on and after the TFTs of pixel III are switched on, the scan line G(n) is pre-charged with the voltage $V_{pre}$ after a time interval $T_1$. The difference between herein and the first and the second embodiments is that black frame insertion time occupies about 30% of the whole frame, thus the insertion can be implemented before the TFT of the pixel I of the next frame is switched on. However, for the purpose of liquid crystal overdrive and reduced power consumption, the time interval $T_3$ has to be far longer than the time interval $T_1$. Therefore, the time interval $T_1$ has to start after the TFT of pixel III is switched on within a very short interval, and the scan line G(n) is pre-charged with $V_{pre}$ thereat.

When the voltage level of the pixel electrode $V_p$(I) is larger than the voltage level Vcom of the common electrode, a positive pre-charge voltage $V_{pre}$(+) is applied. Whereas when the voltage level of the pixel electrode $V_p$(I) is smaller than the voltage level $V_{com}$ of the common electrode, a negative pre-charge voltage $V_{pre}$(−) is applied, depending on polarity.

Figure 7B:
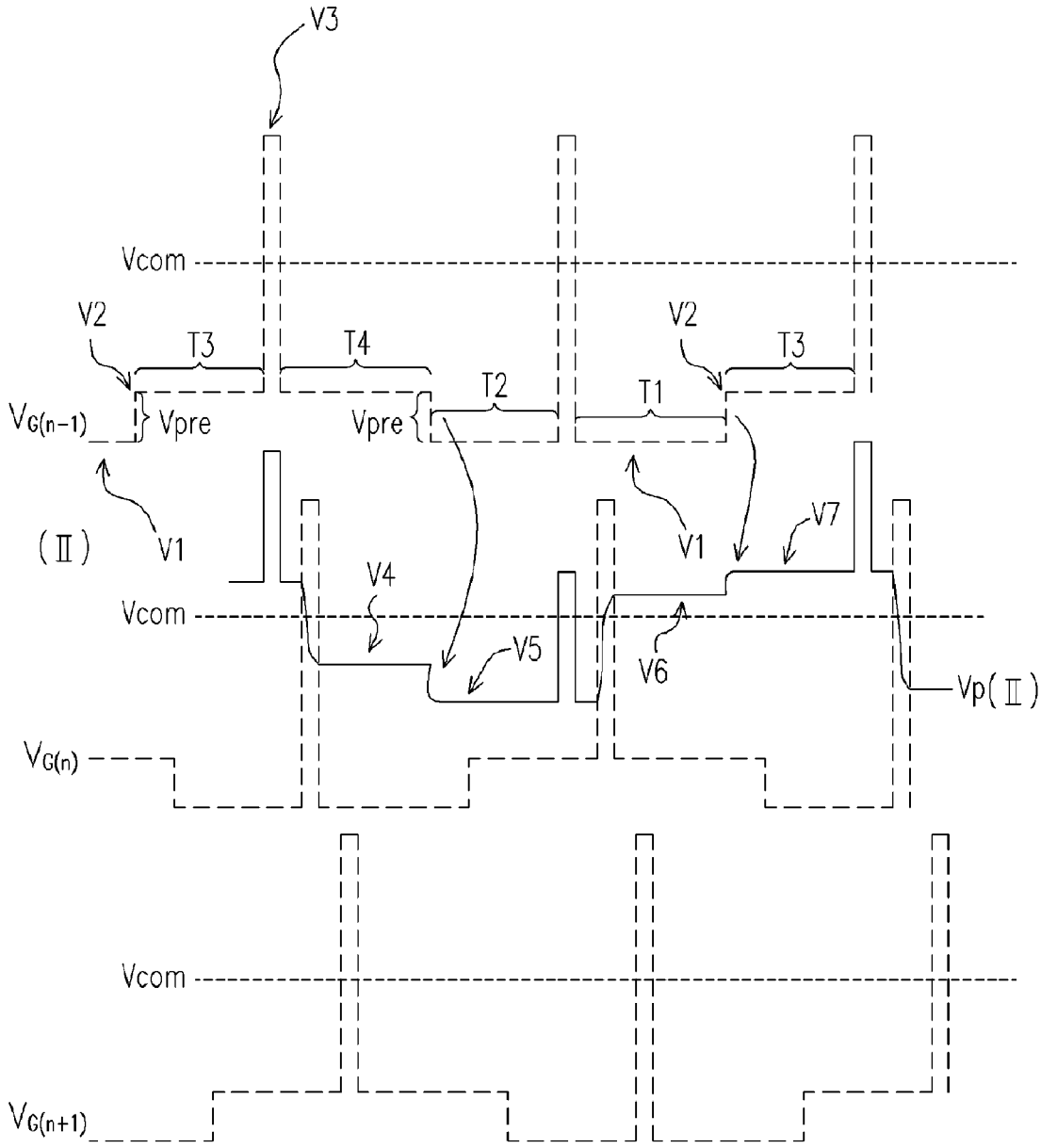
Figure 7C:
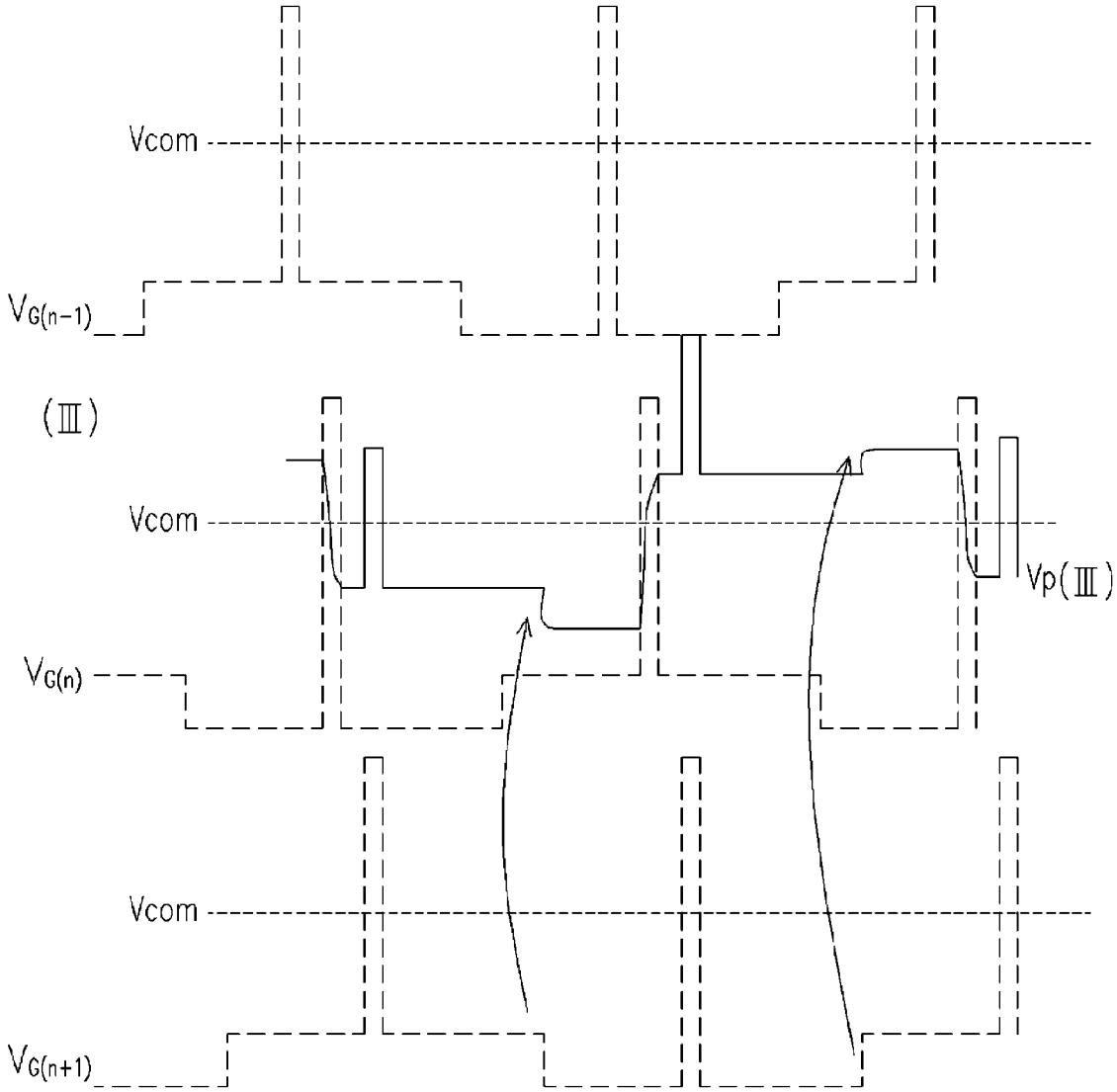
Figure 7D:
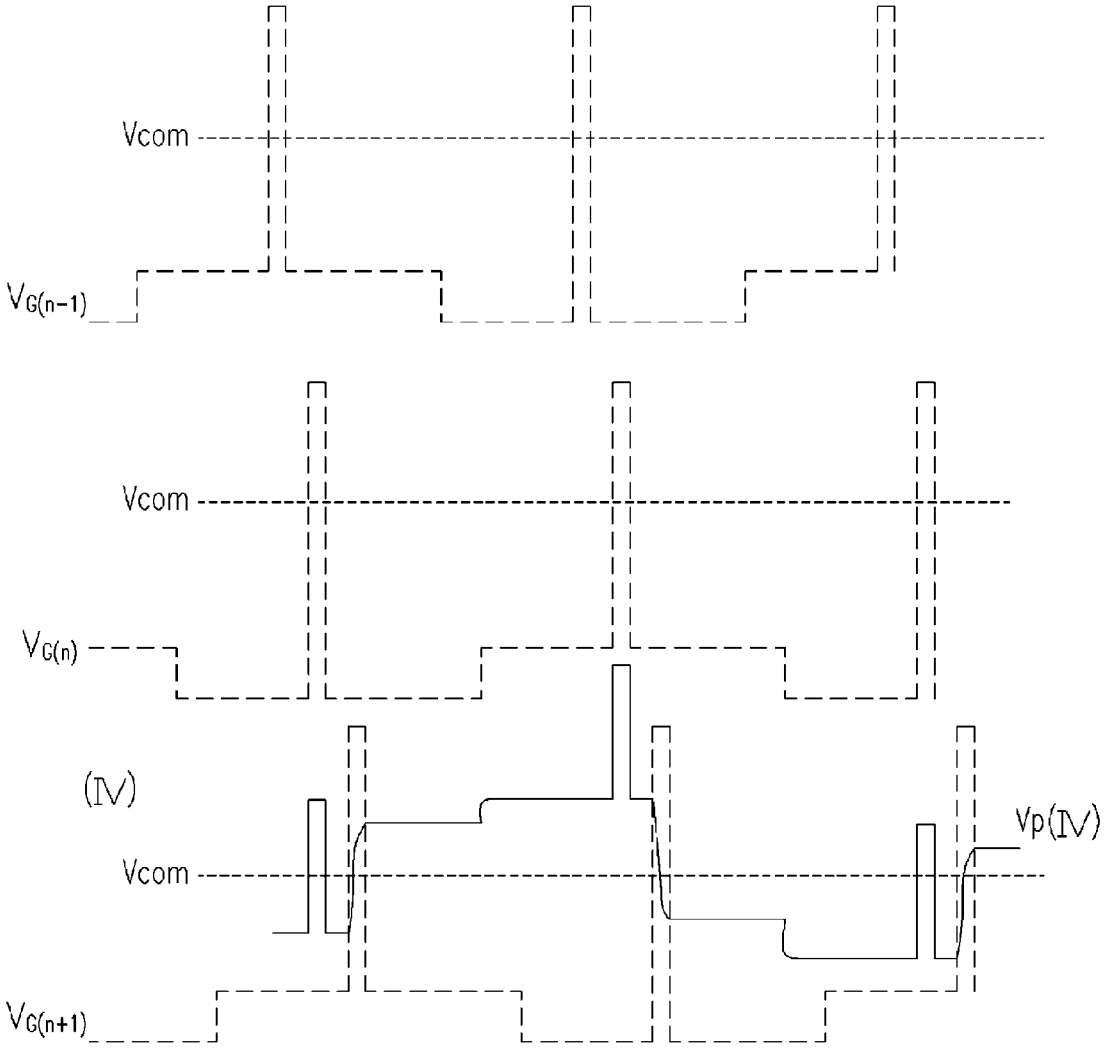

An identical driving method and description thereof is suitable for signal waveform diagrams illustrated in FIGS. 7B to 7D. A driving signal waveform diagram of pixel III in FIG. 7C is identical to FIG. 7A, thus is omitted herein.

A driving signal waveform diagram for pixel II is depicted in FIG. 7B, and a driving signal waveform diagram for pixel IV is depicted in FIG. 7D. In FIG. 7B, a gate of each of the pixels of the LCD array is capacitively coupled to the storage capacitor of a next stage pixel along the same signal line as depicted on right side of FIG. 7. Therefore, the time when a scan line of a previous stage is biased with a pre-charge voltage $V_{pre}$ is within a very short time interval after the TFT of the pixel that is capacitively coupled to the scan line is switched on. A negative pre-charge voltage $V_{pre}$(−) is applied as the arrow symbol on left hand side of FIG. 7B depicted, or a positive pre-charge voltage Vpre(+) is applied as the arrow symbol on right hand side of FIG. 7B depicted. A driving signal waveform diagram depicting pixel IV in FIG. 7D is similar to that in FIG. 7B, hence description thereof is skipped herein.

Signal Waveform of the Scan Line G(n−1)

Referring to FIG. 7B, a driving signal waveform diagram of pixel II is described herein. The black solid line on top of the figure depicts voltage level of pixel electrode of pixel II, i.e. $V_p$(II) in the figure. As the TFTs of pixel I along the scan line G(n−1) are switched on, the scan line G(n) is pre-charged with a voltage $V_{pre}$ such that the voltage level $V_{G(n-1)}$ of the scan line G(n−1) is biased from a voltage level $V_1$ to $V_2$ within the first time interval $T_3$, where $V_{pre}$ does not manages to switch on the TFT thereof. The scan line G(n−1) is again biased with a pre-charge voltage such that $V_{G(n-1)}$ is biased from voltage level $V_2$ to voltage level $V_3$, for switching on all TFTs of pixel I. The voltage level $V_{G(n-1)}$ of the scan line G(n−1) is then changed back to $V_2$ retaining for a time interval $T_4$, and change back to $V_1$ retaining for a time interval $T_2$.

Voltage Level of the Pixel Electrode of Pixel II

According to the foregoing description, along the same signal line D(m), the storage capacitor of pixel II is coupled to the scan line G(n−1). Therefore, the signal waveform of the scan line G(n−1) is depicted as the upper part of FIG. 7B. Since the storage capacitor of pixel II is coupled to the scan line G(n−1), when the voltage level $V_{G(n-1)}$ of the scan line G(n−1) is changed from $V_2$ to $V_1$ and retaining for a second time interval $T_2$ as the arrow symbol depicted on left side of the figure. Thus the voltage level difference between $V_2$ and $V_1$ is fed back to the pixel electrode of pixel Ii via the storage capacitor, such that the voltage level $V_p$ (II) of pixel II is changed from $V_4$ to $V_5$ which differs from $V_{com}$ even further. The variation amount is featured as desired. For example, the variation amount is $(C_{st}/C_{total})\cdot V_{pre}$, where $C_{st}$ is the storage capacitance of pixel II and $C_{total}$ is the total capacitance of the pixel electrode of pixel II. That is, the amount of voltage level variation of the pixel electrode is featured with the pre-charge voltage $V_{pre}$ as desired.

Different from black frame insertion, the increasing time of the voltage level of the pixel electrode is hundreds to thousands times longer than that of the voltage level remained unchanged. For example, the increasing time of the voltage level of the pixel electrode is in millisecond order (ms), the time of that remaining unchanged is in microsecond (μs) order. Of course the difference can be modified upon request. That is, the time interval $T_4$ that the voltage level of the scan line G(n−1) is retained at $V_4$ is far shorter than the time interval $T_2$. For example, if the time interval $T_2$ is in millisecond order, the time interval $T_4$ is in microsecond order, differed from hundreds to thousands of times. Thereinafter, when the polarity of pixel II is flipped, as the second arrow of on right of the figure shows, when the voltage level of the pixel electrode of pixel II is larger than the voltage level $V_{com}$ of the common electrode, the voltage level $V_{G(n-1)}$ of the scan line G(n−1) is increased from a voltage level $V_1$ to $V_2$. When the pre-charge voltage $V_{pre}$ is coupled to the pixel electrode of pixel II via the storage capacitor, such that voltage level of the pixel electrode is changed from $V_6$ to $V_7$ differed from $V_{com}$ by further more.

According to the above description, if a gate of each of the pixels of the LCD is coupled to a storage capacitor of a previous stage pixel along a same signal line in a capacitively coupling fashion. The time when the scan line is pre-charged with the voltage $V_{pre}$ is after the data written in the TFTs of the pixel that is capacitively coupled to the scan line, and within a short time interval after the TFT of the pixel is switched on.

When the voltage level of the pixel electrode $V_p$(I) is larger than the voltage level $V_{com}$ of the common electrode, a positive pre-charge voltage $V_{pre}$(+) is applied. Whereas when the voltage level of the pixel electrode $V_p$(I) is smaller than the voltage level $V_{com}$ of the common electrode, a negative pre-charge voltage $V_{pre}$(−) is applied, depending on polarity.

The Fourth Embodiment

Figure 8:
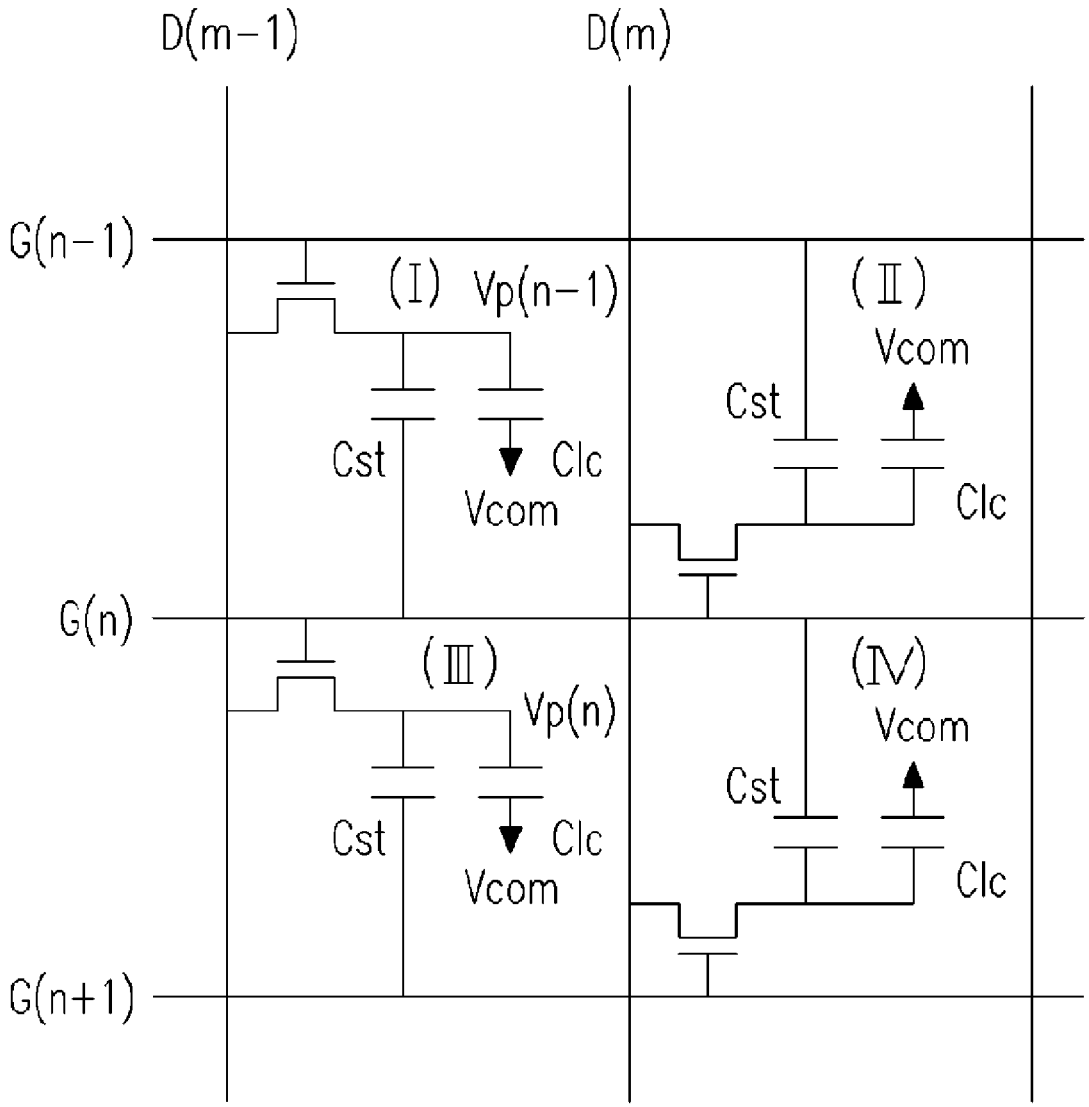
FIG. 8 is a schematic structure diagram illustrating a liquid crystal display according to an embodiment of the present invention.

In another embodiment of the present invention, a driving method with liquid crystal overdrive and reduced power consumption is provided as illustrated in FIG. 8. Referring to FIG. 8, the LCD structure includes scan lines G(n−1), G(n), and G(n+1), and signal lines D(m−1) and D(m). The corresponding pixels to the structured built with scan lines G(n−1), G(n), G(n+1) and signal lines D(m−1) and D(m) are pixel I, pixel II, pixel III, and pixel IV as illustrated in the figure. Where a gate of the TFT of the pixel I is coupled to the scan line G(n−1), gates of the TFTs of the pixel II and III are coupled to the scan line G(n), and a gate of the TFT of the pixel IV is coupled to the scan line G(n+1). Sources of the TFTs of the pixel I and pixel III are coupled to the signal line D(m−1), and sources of the pixel II and pixel IV are coupled to the signal line D(m).

Referring to FIGS. 8A to 8D, schematic waveform diagrams of driving methods for pixel I, pixel II, pixel III and pixel IV are illustrated. The difference between this embodiment and the previous embodiment is the signal waveform applying to the scan line, which is described hereinafter along with the figures.

Figure 8A:
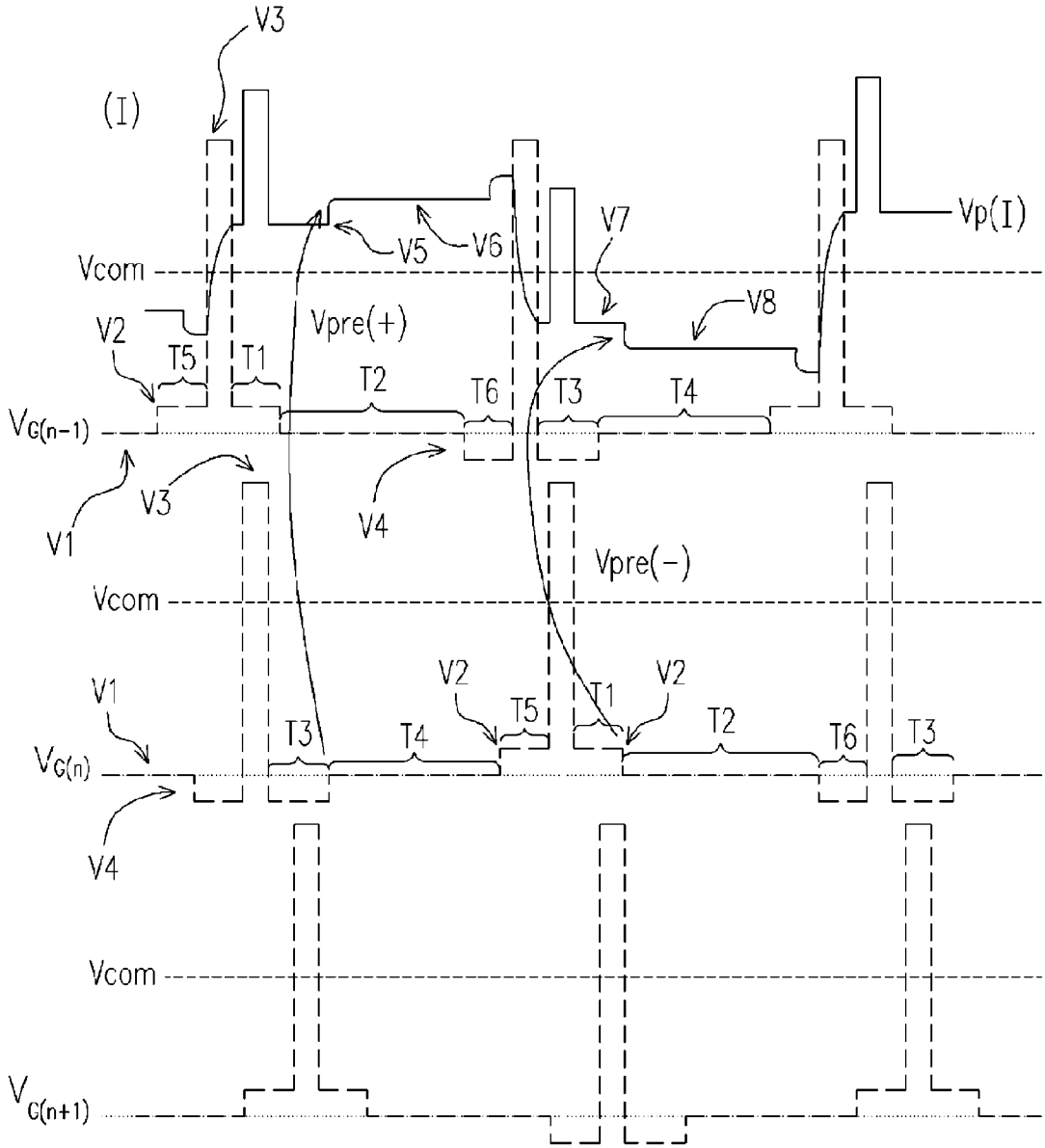
FIG. 8A to 8D are signal waveform diagrams of the liquid crystal display in FIG. 8 illustrating driving methods for pixel I, pixel II, pixel III, and pixel IV respectively according to one embodiment of the present invention.

Referring to FIG. 8A, a signal waveform diagram of pixel I is illustrated herein. The black solid line on top of the figure depicts voltage level of pixel electrode of pixel I, i.e. $V_p$(I) in the figure. And the thick dotted line is signal waveform of the scan line G(n−1). Hereinafter, the waveform of the signal of the scan line G(n) that affects the voltage level of the pixel electrode of pixel I is described. Signal waveforms of other scan lines are similar, thus are not further described.

Signal Waveform of the Scan Line G(n)

Referring to middle part of FIG. 8A, as the TFTs of pixel I is switched on and as the TFTs of the pixel III is switched on, the scan line G(n) is pre-charged with a voltage $V_{pre}$ biasing from a voltage level $V_3$ down to $V_4$ within the first time interval $T_3$, where $V_{pre}$ does not manages to switch on the TFT thereof. The scan line G(n) is again biased from voltage level $V_4$ to voltage level $V_1$ for a time interval $T_4$. The scan line is then biased with a positive pre-charge voltage $V_{pre}$, such that the voltage level $V_{G(n)}$ is changed from $V_1$ to $V_2$ and retaining for a time interval $T_5$. Thereinafter, the scan line G(n) is biased with a scan voltage, such that the voltage level is changed from $V_2$ to $V_3$ for switching on the TFT of pixel III. Then the voltage level $V_{G(n)}$ of the scan line G(n) is biased from the voltage level $V_3$ to $V_2$ and retaining for a time interval $T_1$. The voltage level $V_{G(n)}$ of the scan line G(n) is then changed from $V_2$ down to $V_4$ retaining for a time interval $T_6$.

The foregoing signal waveforms applying to the scan ling G(n) are also suitable to other scan lines. The foregoing time intervals $T_1$, $T_2$, $T_3$, $T_4$, $T_5$, and $T_6$ are featured as desired. In one embodiment of the present invention, the time intervals $T_1$, $T_3$, $T_5$ and $T_6$ are far shorter than the time intervals $T_2$ and $T_4$. For example, if the time intervals $T_2$ and $T_4$ are in millisecond (ms) order, the time intervals $T_1$, $T_3$, $T_5$ and $T_6$ are in microsecond (μs) order, differed by hundreds to thousands of times.

Voltage Level of the Pixel Electrode of Pixel I

According to the foregoing description, along the same signal line D(m−1), the storage capacitor of pixel I is coupled to a gate of the TFT of pixel III, and the storage capacitor of pixel III is also coupled to a gate of the TFT of a next stage pixel. Therefore, the signal waveform of the scan line G(n) of pixel III is depicted as the middle part of FIG. 8A. Since the storage capacitor of pixel I is coupled to the gate of TFT of pixel III, when the scan line biased from a voltage level $V_4$ to a voltage level $V_1$, the pre-charge voltage $V_{pre}$ is capacitively feedback coupled to the pixel electrode of pixel I via the storage capacitor as the first arrow symbol on left side of the figure shows. Thus the voltage level of the pixel electrode of pixel I $V_p$(I) is increased from $V_5$ to $V_6$.

As the pre-charge voltage $V_{pre}$ is capacitively coupled to the pixel electrode of pixel I via the scan line G(n) and storage capacitor, for example, the voltage variation of the pixel electrode is $(C_{st}/C_{total})\cdot V_{pre}$, where $C_{st}$ is the storage capacitance of pixel I and $C_{total}$ is the total capacitance of the pixel electrode of pixel I. That is, the amount of voltage level variation of the pixel electrode is featured with the pre-charge voltage $V_{pre}$ as desired.

The increasing time of the voltage level of the pixel electrode, that is the time interval that voltage level remaining at $V_6$ within in a field, is hundreds to thousands times longer than that of the voltage level remained at $V_5$. For example, the increasing time of the voltage level of the pixel electrode is in millisecond order (ms), the time of that remaining unchanged is in microsecond (μs) order. Of course the difference can be modified upon request.

Thereinafter, when the polarity is flipped, as the second arrow of on right of the figure shows, when the voltage level $V_p$(I) of the pixel electrode of pixel I is smaller than the voltage level $V_{com}$ of the common electrode, the voltage level $V_{G(n)}$ of the scan line G(n) of pixel III is biased from a scan voltage level back to $V_2$, remaining for a time interval $T_1$, and back to $V_1$ remaining for a time inter $T_2$. When the scan line G(n) is biased from the voltage level $V_2$ back to $V_1$, the voltage variation amount is coupled to the pixel electrode of pixel I via the storage capacitor, such that voltage level of the pixel electrode $V_p$(I) is changed from $V_7$ to $V_8$ differed from $V_{com}$ by further more.

According to the above description, if a gate of each of the pixels of the LCD is coupled to a storage capacitor of a previous stage pixel along a same signal line in a capacitively coupling fashion. Referring to FIG. 8A, it is seen that the voltage level $V_p$(I) of the pixel electrode of pixel I is capacitively coupled via the storage capacitor of pixel I from the scan line G(n). As to the signal waveform applied to the scan line G(n), where pixel I being positive in polarity is exemplary, after the TFT corresponding to the scan line G(n) is switched on, the voltage level $V_{G(n)}$ is biased to voltage level $V_4$ for a time interval $T_3$, and biased to voltage level $V_1$ for a time interval $T_4$. The time interval $T_5$ that the voltage level $V_p$(I) remaining at $V_5$ is far shorter than that remaining at $V_6$.

When pixel I is negative in polarity, after the TFT corresponding to the scan line G(n) is switched on, the voltage level $V_{G(n)}$ is biased to voltage level $V_2$ for a time interval $T_1$, and biased to voltage level $V_1$ for a time interval $T_2$. The time interval that the voltage level $V_p$(I) remaining at $V_7$ is far shorter than that remaining at $V_8$. The foregoing time intervals $T_1$, $T_2$, $T_3$, $T_4$, $T_5$ and $T_6$ are adjustable upon desired.

Figure 8B:
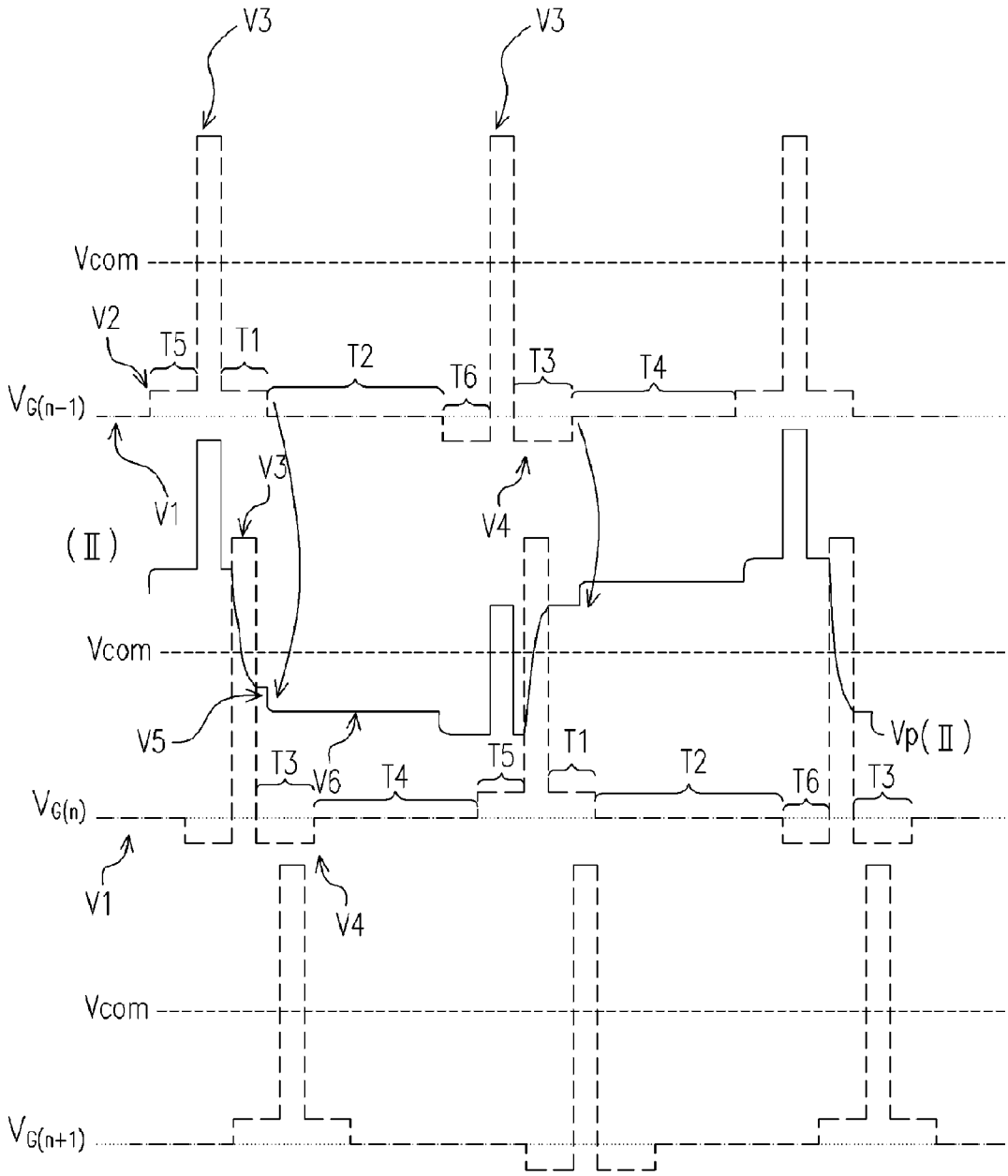
Figure 8C:
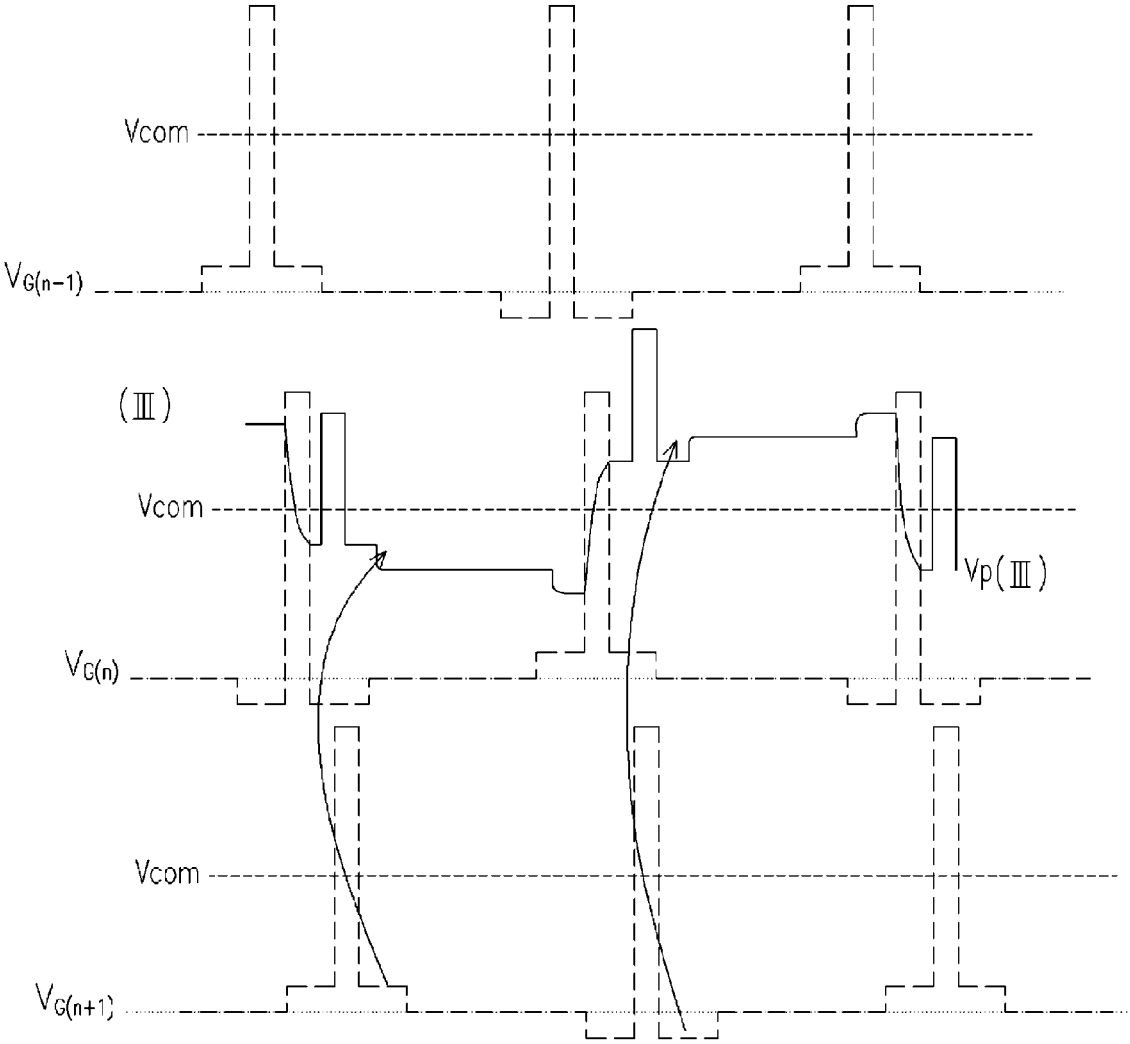
Figure 8D:
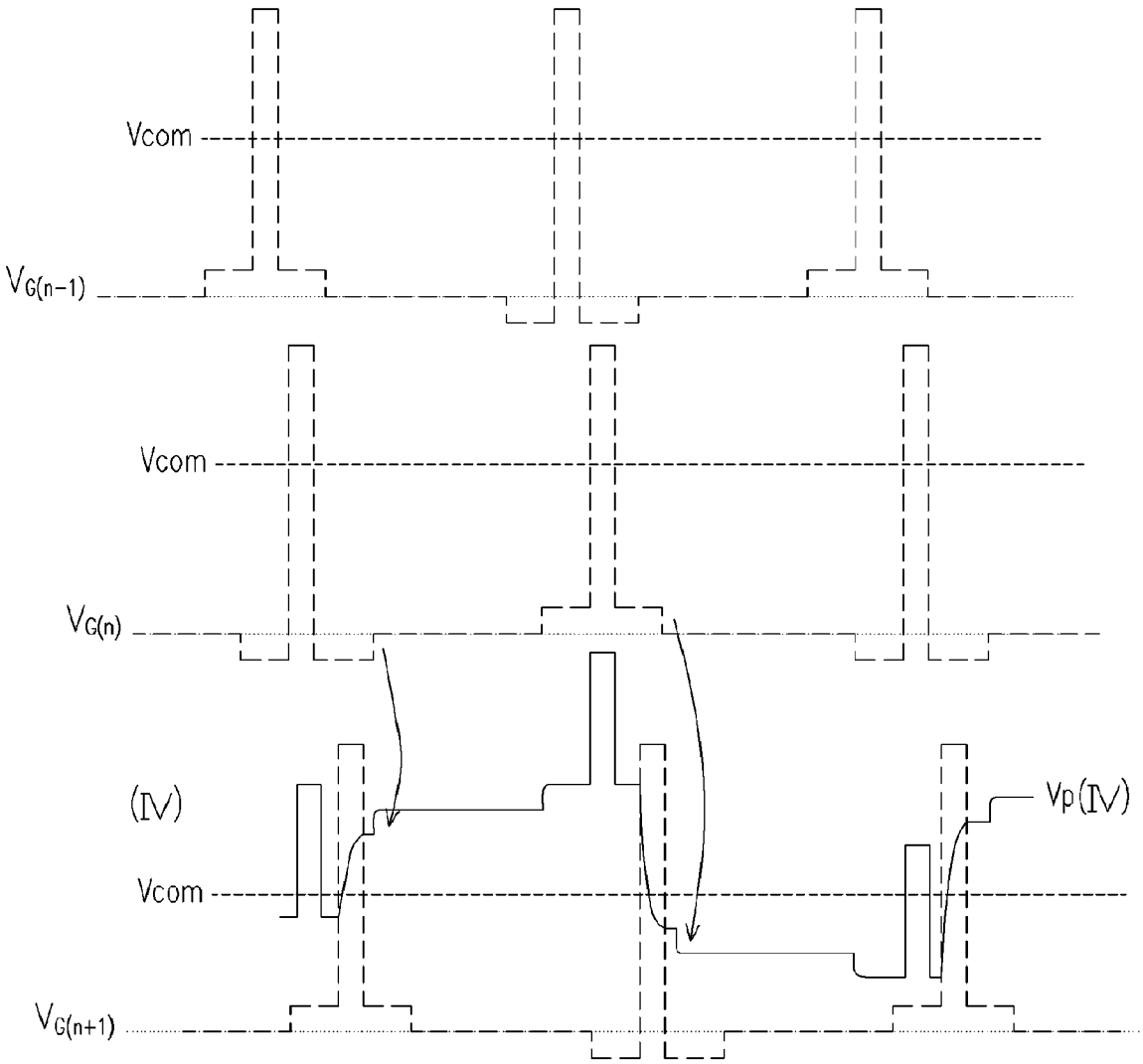

An identical driving method and description thereof is suitable for signal waveform diagrams illustrated in FIGS. 8B to 8D. A driving signal waveform diagram of pixel III in FIG. 8C is identical to FIG. 8A, thus is omitted herein.

A driving signal waveform diagram for pixel II is depicted in FIG. 8B, and a driving signal waveform diagram for pixel IV is depicted in FIG. 8D. In FIG. 8B, the scan line G(n−1) is capacitively coupled to the voltage level $V_p$(II) of the pixel electrode of the pixel II via the storage capacitor thereof. For the signal waveform applied to the scan line G(n−1), as the TFT of pixel I is switched on, the voltage level $V_{G(n-1)}$ of the scan line G(n−1) is biased from a voltage level $V_3$ to a voltage level $V_2$ for a time interval $T_1$. Thereinafter the voltage level $V_{G(n-1)}$ of the scan line G(n−1) is biased from a voltage level $V_2$ to a voltage level $V_1$ for a time interval $T_2$. After $T_2$, the voltage level $V_{G(n-1)}$ of the scan line G(n−1) is biased from a voltage level $V_1$ to a voltage level $V_4$ for a time interval $T_6$. Then the voltage level $V_{G(n-1)}$ of the scan line G(n−1) is biased from a voltage level $V_4$ to a voltage level $V_3$, and from a voltage level $V_3$ to a voltage level $V_4$ for a time interval $T_3$ as described above.

The foregoing time intervals $T_1$, $T_2$, $T_3$, $T_4$, $T_5$ and $T_6$ are adjustable upon desired. In the embodiment of the present invention, time intervals $T_1$, $T_3$, $T_5$ and $T_6$ are far shorter than $T_2$ and $T_4$. For example, the time intervals $T_2$ and $T_4$ are in millisecond order (ms), the time intervals $T_1$, $T_3$, $T_5$ and $T_6$ are about in microsecond (μs) order, differed from hundreds to thousands of times. Of course the difference can be modified upon request.

It is noted from FIG. 8B that when pixel II is negative in polarity, the time needed by that the voltage level of the scan line G(n−1) being biased from $V_2$ and $V_1$ is short enough after the TFT of pixel II is switched on. The voltage level VP(II) is capacitively coupled via the storage capacitor of pixel II, as the first arrow symbol depicted on left-hand side of the figure. As pixel II is positive in polarity, the time needed by that the voltage level of the scan line G(n−1) being biased from $V_4$ and $V_1$ is short enough after the TFT of pixel II is switched on. The voltage level VP(II) is capacitively coupled via the storage capacitor of pixel II. Besides, the time that the voltage level of G(n−1) is biased from V1 to V2 before the TFT of pixel II is switched on, i.e. T5, and the time that the voltage level of G(n−1) is biased from V1 to V4 before the TFT of pixel II is switched on, i.e. T6, are both substantially short. Of course, the voltage level $V_p$(II) of pixel II that is coupled via storage capacitor is featured upon desired.

According to the foregoing embodiments, the present invention provides a driving method for LCD, including pre-charging the scan line with a voltage value before TFT of a pixel of a LCD is switched on, i.e. before the scan line is biased with the scan signal. The pre-charge voltage does not manage to switch on the TFT of the pixel, which is capacitively coupled to the voltage level of a neighboring pixel that is coupled to the same scan line via the storage capacitor thereof.

According to the first and second embodiments of the present invention, the driving method includes biasing the voltage level of the voltage value of the pixel electrode back to or close to a voltage level of the common electrode. Therefore black frame insertion is implemented, i.e. hold-type addressing method can be applied to the LCD for avoiding edge blur.

According to the third and fourth embodiments of the present invention, the driving method is suitable for liquid crystal overdrive and reduced power consumption, where the pixel electrode is pre-charged for overdriving the pixel and reducing power consumption.

The driving method in the present invention, either for black frame insertion, liquid crystal overdrive, power consumption reduction or other purposes, dot inversion driving method is suitable for large dimension requirement of a LCD panel.

Although the invention has been described with reference to a particular embodiment thereof, it will be apparent to those skilled in the art that modifications to the described embodiment may be made without departing from the spirit of the invention. Accordingly, the scope of the invention will be defined by the attached claims and not by the above detailed description.

What is claimed is:

1. A driving method for a display, wherein the display comprises a plurality of scan lines and a plurality of signal lines, each of the scan lines and each of the signal lines are electrically connected to a corresponding pixel via a thin film transistor (TFT), a gate of the TFT is electrically connected to the corresponding scan line, a source of the TFT is electrically connected to the corresponding signal line, a drain of the TFT is electrically connected to a neighboring scan line neighboring to the corresponding scan line via a storage capacitor, the drain is also electrically connected to a common electrode via a pixel electrode of the pixel, and a voltage level of the common electrode is a common voltage value, the driving method comprising:

applying a first pre-charge voltage and a first scan voltage sequentially to a scan line in a first duration;

applying a second pre-charge voltage and a second scan voltage sequentially to the scan line in a second duration adjacent to the first duration, wherein the first pre-charge voltage makes a voltage level of the scan line change from a first voltage level to a second voltage level and then return to the first voltage level, and then the first scan voltage makes the voltage level of the scan line change from the first voltage level to a third voltage level and then return to the first voltage level, wherein the second pre-charge voltage makes the voltage level of the scan line change from the first voltage level to a fourth voltage level and then return to the first voltage level, and then the second scan voltage makes the voltage level of the scan line change from the first voltage level to the third voltage level and then return to the first voltage level, where the first, the second, the third and the fourth voltage levels are different from each other, wherein the first pre-charge voltage and the second pre-charge voltage are opposite in phase relative to the first voltage level, and the amplitudes of the pre-charge voltages are smaller than those of the scan voltages, wherein the pre-charge voltages are incapable of turning on the corresponding TFT, and make a voltage level of the pixel electrode of the pixel return back to or close to that of the common electrode, wherein the amplitude of the third voltage level is larger than that of the second voltage level, and a black frame insertion is performed when the voltage level of the pixel electrode of the pixel has returned back to or close to that of the common electrode, and a duration of the black frame insertion is about 30% of an interval time for displaying an entire frame by the display.

2. The driving method of claim 1, wherein the first duration and the second duration is equal to a frame time.

3. The driving method of claim 1, wherein a first interval time of the first pre-charge voltage is equal to a fourth interval time of the second pre-charge voltage.

4. The driving method of claim 1, wherein the first pre-charge voltage and the second pre-charge voltage have the same voltage difference relative to the first voltage level.

5. The driving method of claim 1, further comprising applying a third pre-charge voltage to the neighboring scan line, the third pre-charge voltage being coupled to the pixel electrode via the storage capacitor, wherein the voltage level variation of the pixel electrode is Cst/Ctotal·(Vpre), where Vpre is a value of the third pre-charge voltage, Cst is storage capacitance of the pixel, and Ctotal is total capacitance of the pixel electrode.

6. The driving method of claim 1, further comprising applying a third pre-charge voltage to the one end of the storage capacitor, the third pre-charge voltage being coupled to the pixel electrode via the storage capacitor, wherein the voltage level variation of the pixel electrode is Cst/Ctotal·(Vpre), where Vpre is a value of the third pre-charge voltage, Cst is storage capacitance of the pixel, and Ctotal is total capacitance of the pixel electrode.

7. The driving method of claim 1, further comprising applying a third pre-charge voltage to the neighboring scan line, wherein the third pre-charge voltage is coupled to the pixel electrode via the storage capacitor, and then the voltage level of the pixel electrode is changed to substantially equal the common voltage level.

8. The driving method of claim 1, further comprising applying a third pre-charge voltage to the storage capacitor, wherein the third pre-charge voltage is coupled to the pixel electrode via the storage capacitor, and then the voltage level of the pixel electrode is changed to substantially equal the common voltage level.

9. The driving method of claim 1, wherein the first and the second pre-charge voltage levels are lower than a voltage for turning on the corresponding TFT.

10. A driving method for a display, wherein the display comprises a plurality of scan lines and a plurality of signal lines, each of the scan lines and each of the signal lines are electrically connected to a corresponding pixel via a thin film transistor (TFT), a gate of the TFT is electrically connected to the corresponding scan line, a source of the TFT is electrically connected to the corresponding signal line, a drain of the TFT is electrically connected to a neighboring scan line neighboring to the corresponding scan line via a storage capacitor, the drain is also electrically connected to a common electrode via a pixel electrode of the pixel, and a voltage level of the common electrode is a common voltage value, the driving method comprising:

only applying a pre-charge voltage and a scan voltage sequentially to a first scan line in a frame;

coupling the pre-charge voltage to a second pixel electrode of the neighboring pixel corresponding to a second scan line via a second storage capacitor, wherein the pre-charge voltage coupled to the pixel electrode of the pixel corresponding to the second scan line makes the voltage level of the pixel electrode back to or close to that of the common electrode, wherein the pre-charge voltage makes the voltage level of the first scan line change from a first voltage level to a second voltage level and then return to the first voltage level, and then the scan voltage makes the voltage level of the first scan line directly change from the first voltage level to a third voltage level and then directly return to the first voltage level, where the first, the second and the third voltage levels are different from each other, wherein the amplitude of the pre-charge voltage is smaller than that of the scan voltage and the pre-charge voltage is incapable of turning on the TFT, wherein the amplitude of the third voltage level is larger than that of the second voltage level, and a black frame insertion is performed when the voltage level of the pixel electrode of the pixel has returned back to or close to that of the common electrode, and a duration of the black frame insertion is about 30% of an interval time for displaying an entire frame by the display.

11. The driving method of claim 10, wherein the pre-charge voltage level is lower than a voltage for turning on the corresponding TFT.

12. A driving method for a display, wherein the display comprises a plurality of scan lines and a plurality of signal lines, each of the scan lines and each of the signal lines are electrically connected to a corresponding pixel via a thin film transistor (TFT), a gate of the TFT is electrically connected to the corresponding scan line, a source of the TFT is electrically connected to the corresponding signal line, a drain of the TFT is electrically connected to a neighboring scan line neighboring to the corresponding scan line via a storage capacitor, the drain is also electrically connected to a common electrode via a pixel electrode of the pixel, and a voltage level of the common electrode is a common voltage value, the driving method comprising:

applying a first pre-charge voltage and a first scan voltage sequentially to a scan line in a first duration;

applying a second pre-charge voltage and a second scan voltage sequentially to the scan line in a second duration adjacent to the first duration, wherein the first pre-charge voltage makes the voltage level of the scan line change from a first voltage level to a second voltage level and then return to the first voltage level, and then the first scan voltage makes the voltage level of the scan line change from the first voltage level to a third voltage level and then return to the first voltage level, wherein the second pre-charge voltage makes the voltage level of the scan line change from the first voltage level to a fourth voltage level and then return to the first voltage level, and then the second scan voltage makes the voltage level of the scan line change from the first voltage level to the third voltage level and then return to the first voltage level, where the first, the second, the third and the fourth voltage levels are different from each other, wherein the first pre-charge voltage and the second pre-charge voltage are opposite in phase relative to the first voltage level, and the amplitudes of the pre-charge voltages are smaller than those of the scan voltages, wherein the pre-charge voltages are incapable of turning on the TFT, and make a voltage level of the pixel electrode of the pixel return back to or close to that of the common electrode, wherein the amplitude of the third voltage level is larger than that of the second voltage level, and during a pre-charge period of applying the first or the second pre-charge voltage, no data voltage requires to be applied to the signal lines.

13. The driving method of claim 12, wherein a black frame insertion is performed when the voltage level of the pixel electrode of the pixel has returned back to or close to that of the common electrode, and a duration of the black frame insertion is about 30% of an interval time for displaying an entire frame by the display.

* * * * *